US007150518B2

(12) United States Patent
Watanabe

(10) Patent No.: US 7,150,518 B2
(45) Date of Patent: Dec. 19, 2006

(54) INKJET HEAD

(75) Inventor: Hidetoshi Watanabe, Tokoname (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 209 days.

(21) Appl. No.: 10/912,388

(22) Filed: Aug. 6, 2004

(65) Prior Publication Data

US 2005/0036011 A1 Feb. 17, 2005

(30) Foreign Application Priority Data

Aug. 11, 2003 (JP) ..... 2003-291096

(51) Int. Cl.
*B41J 2/045* (2006.01)

(52) U.S. Cl. ..... 347/71

(58) Field of Classification Search ..... 347/68–72; 29/25.35

See application file for complete search history.

(56) References Cited

U.S. PATENT DOCUMENTS 5,818,482 A 10/1998 Ohta et al.
6,174,051 B1 * 1/2001 Sakaida ..... 347/72
6,364,468 B1 * 4/2002 Watanabe et al. ..... 347/68
2003/0122902 A1 7/2003 Sakaida et al.

FOREIGN PATENT DOCUMENTS

JP A 11-34323 2/1999

* cited by examiner

*Primary Examiner*—An H. Do
(74) *Attorney, Agent, or Firm*—Oliff & Berridge, PLC

(57) ABSTRACT

An inkjet head includes an actuator unit, and a flow path unit. Individual electrodes are formed on a piezoelectric sheet of the actuator unit. Pressure chambers are formed in a cavity plate of the flow path unit. Each individual electrode has a main electrode region disposed in a position opposite to a corresponding pressure chamber, and a land portion connected to the main electrode region. Overhang portions protruding in a direction along a surface of the cavity plate are formed in side walls of each pressure chamber. Each land portion at least partially overlaps a corresponding overhang portion at a height level (top height level) of a contact surface between the cavity plate and the actuator unit.

11 Claims, 14 Drawing Sheets

INKJET HEAD

BACKGROUND OF THE INVENTION

1. Field of the Invention

The present invention relates to an inkjet head used in an inkjet recording apparatus which ejects ink onto a recording medium to perform printing.

2. Description of the Related Art

In an inkjet head described in JP-A-11-34323 (Page 3, FIG. 1), each of individual electrodes (upper electrodes) separately formed in accordance with pressure chambers (pressurizing chambers) respectively has a main electrode region (body) formed in a planar direction parallel to a piezoelectric sheet (piezoelectric film) so as to be smaller than a corresponding pressure chamber, and an extension portion extending from the main electrode region to the outside of the pressure chamber region. A land portion, which serves as a point of contact with another member, is provided in a position of the extension portion on the outside of the pressure chamber region. Another member such as wiring is connected to the land portion by soldering or pressure-bonding of a contact member. In this manner, the land portion is provided on the outside of the region of the piezoelectric sheet opposite to the pressure chamber, so that distortional deformation of the region of the piezoelectric sheet opposite to the pressure chamber is not suppressed by the land portion.

SUMMARY OF THE INVENTION

When a plurality of pressure chambers are arranged adjacently to achieve high-density printing in the inkjet head described in JP-A-11-34323, each land portion is however located relatively near to the main electrode regions of adjacent individual electrodes because each land portion is provided on the outside of the region of the piezoelectric sheet opposite to a corresponding pressure chamber. On the other hand, a diaphragm serving as the common electrode has regions opposite to the land portions respectively and is arranged so as to be laid over the plurality of pressure chambers. As a result, when a voltage is applied between the two electrodes, deformation based on the transverse piezoelectric effect of the piezoelectric device occurs in the regions of the piezoelectric sheet near to the land portions. The deformation exerts influence on distortional deformation of the piezoelectric sheet at regions opposite to the main electrode regions of adjacent individual electrodes, so that crosstalk having bad influence on ink ejection from the required pressure chambers occurs.

It is an object of the invention to provide an ink-jet head in which crosstalk can be suppressed while high-density arrangement of pressure chambers can be achieved.

According to one aspect of the invention, there is provided with a flow path unit including pressure chambers arranged along a plane and connected to nozzles respectively; and an actuator unit fixed to a surface of the flow path unit which changes the volume of each of the pressure chambers. The actuator unit includes: individual electrodes each having a main electrode region disposed in a position opposite to corresponding one of the pressure chambers, and a sub electrode region continued to the main electrode region and connected to a signal line; a common electrode provided so as to be laid over the pressure chambers or a common electrode kept at common electric potential; and a piezoelectric sheet put between the common electrode and the individual electrodes or a piezoelectric sheet put between the common electrode and the individual electrodes so as to be laid over the pressure chambers. The flow path unit includes overhang portions provided in the pressure chambers in such a manner that at least the amount of protrusion of each of side walls of each pressure chamber in a direction along the plane at a top height level as the height nearest to the actuator unit is larger than the amount of protrusion of each of side walls of each pressure chamber in the direction along the plane at any height level different from the top height level on the assumption that the height level is virtually provided in a direction from the pressure chamber to the actuator unit. Each sub electrode region is disposed between a position where the center of the sub electrode region overlaps an outer edge of a corresponding overhang portion on a side facing the pressure chamber at the top height level and a position where the sub electrode region does not overlap a corresponding overhang portion at the top height level but an outer edge of the sub electrode region overlaps an outer edge of a corresponding overhang portion on a side not facing the pressure chamber.

According to this configuration, because each sub electrode region is disposed in a position relatively near to the main electrode region connected to the sub electrode region but relatively far from adjacent individual electrodes, crosstalk caused by displacement of the piezoelectric sheet opposite to the sub electrode regions can be suppressed even in the case where the inkjet head is provided as a small-size head having pressure chambers arranged densely. Accordingly, even in the case where ink is ejected from nozzles connected to adjacent pressure chambers simultaneously, ink can be ejected in the same manner as in the case where ink is ejected from nozzles independently. As a result, print speed is improved. Moreover, because at least one part of the sub electrode region overlaps the overhang portion, the sub electrode region and the signal line can be pressure-bonded to each other by sufficient pressure. Moreover, because each sub electrode region is disposed so that the center of the sub electrode region is not located in the inside of the pressure chamber over the outer edge of the overhang portion on a side facing the pressure chamber at the top height level, the piezoelectric sheet can be prevented from being broken by the pressure used for bonding the sub electrode region and the signal line to each other. As described above, in accordance with the invention, there can be obtained a small-size head in which crosstalk can be suppressed while high-speed printing can be made and which has pressure chambers arranged densely.

According to another aspect of the invention, the center of each sub electrode region overlaps a corresponding overhang portion at the top height level. According to this configuration, crosstalk can be suppressed more greatly.

On this occasion, the whole of each sub electrode region may overlap a corresponding overhang portion at the top height level. According to this configuration, crosstalk can be suppressed more effectively.

According to another aspect of the invention, each pressure chamber is shaped like a parallelogram or a corner-rounded parallelogram having two acute-angled portions in plan view so that each sub electrode region overlaps the overhang portion provided in one of the acute-angled portions of a corresponding pressure chamber. According to this configuration, crosstalk can be reduced while pressure chambers are arranged densely.

According to another aspect of the invention, the individual electrodes and the pressure chambers are disposed in the form of a matrix so that the sub electrode region of each individual electrode is located between the main electrode regions of other two individual electrodes. According to this configuration, an excellent crosstalk reducing effect can be obtained even in the case where pressure chambers are arranged densely.

According to another aspect of the invention, each overhang portion has a region in which the amount of protrusion in the direction along the plane decreases as the height level becomes farther than the top height level. According to this configuration, air bubbles hardly remain in each pressure chamber, so that air bubbles in each pressure chamber can be discharged from the nozzle easily.

According to another aspect of the invention, the flow path unit includes a plurality of sheet members laminated on one another; and the overhang portions are formed in such a manner that one of the sheet members used for forming at least part of spaces of the pressure chambers is etched from a surface opposite to the nozzles. According to this configuration, air bubbles in each pressure chamber can be discharged from the nozzle easily because each of side walls of the pressure chamber corresponding to the overhang portion is shaped like a curved surface.

According to another aspect of the invention, the flow path unit includes a plurality of sheet members laminated on one another; and the overhang portions are formed in such a manner that one of the sheet members used for forming at least part of spaces of the pressure chambers is etched from its opposite surfaces. According to this configuration, positional accuracy of each pressure chamber can be improved because end portions of holes formed by etching can be positioned accurately.

According to another aspect of the invention, a flow path unit includes a plurality of sheet members laminated on one another; and the overhang portions are formed in such a manner that at least two of the sheet members having holes are laminated on each other so that the positions of outer edges facing the holes are different from each other. According to this configuration, the side wall shape of the pressure chamber corresponding to the overhang portion can be decided with a high degree of freedom.

DESCRIPTION OF THE PREFERRED EMBODIMENTS

Embodiments of the invention will be described below with reference to the drawings.

Figure 1:
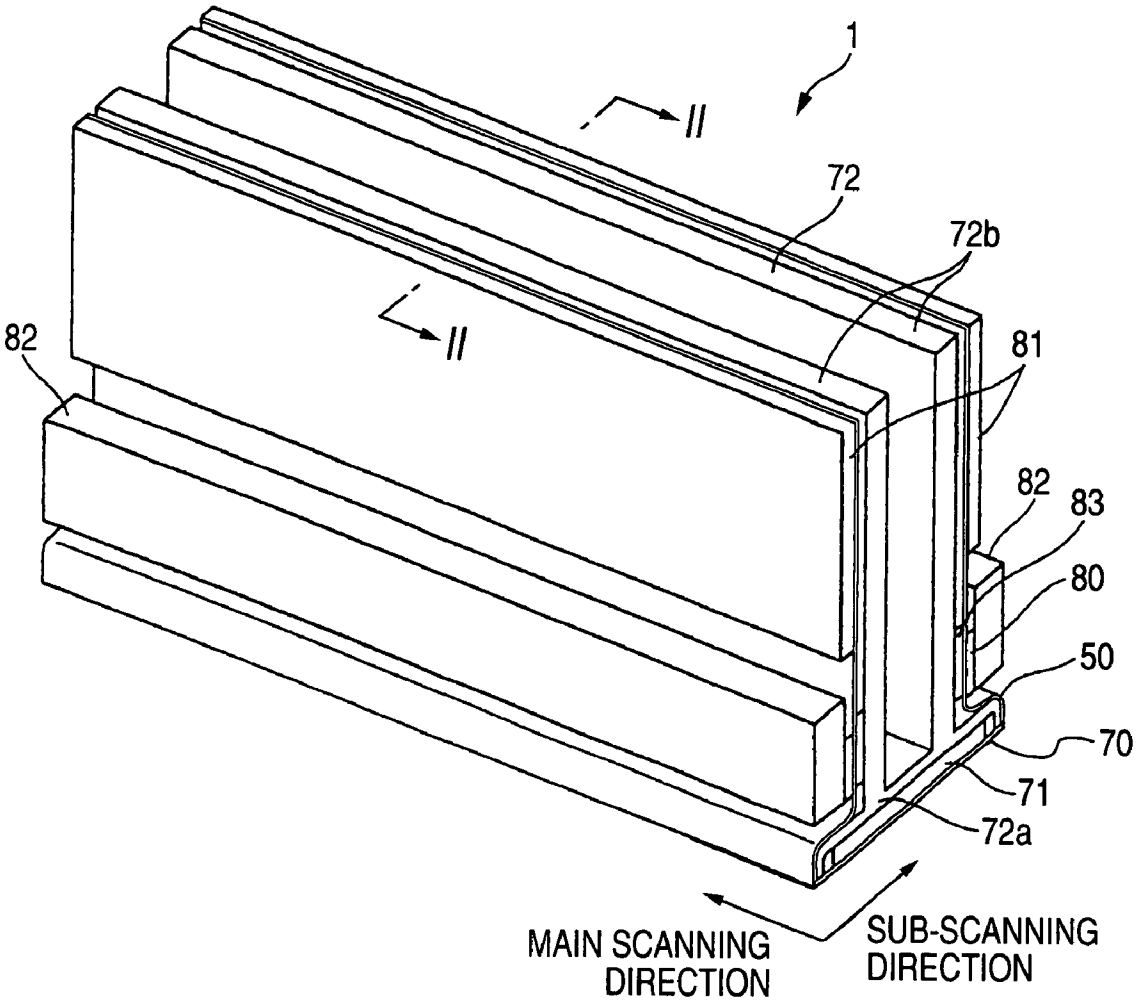
FIG. 1 is a perspective view showing the external appearance of an inkjet head according to an embodiment of the invention.
Figure 2:
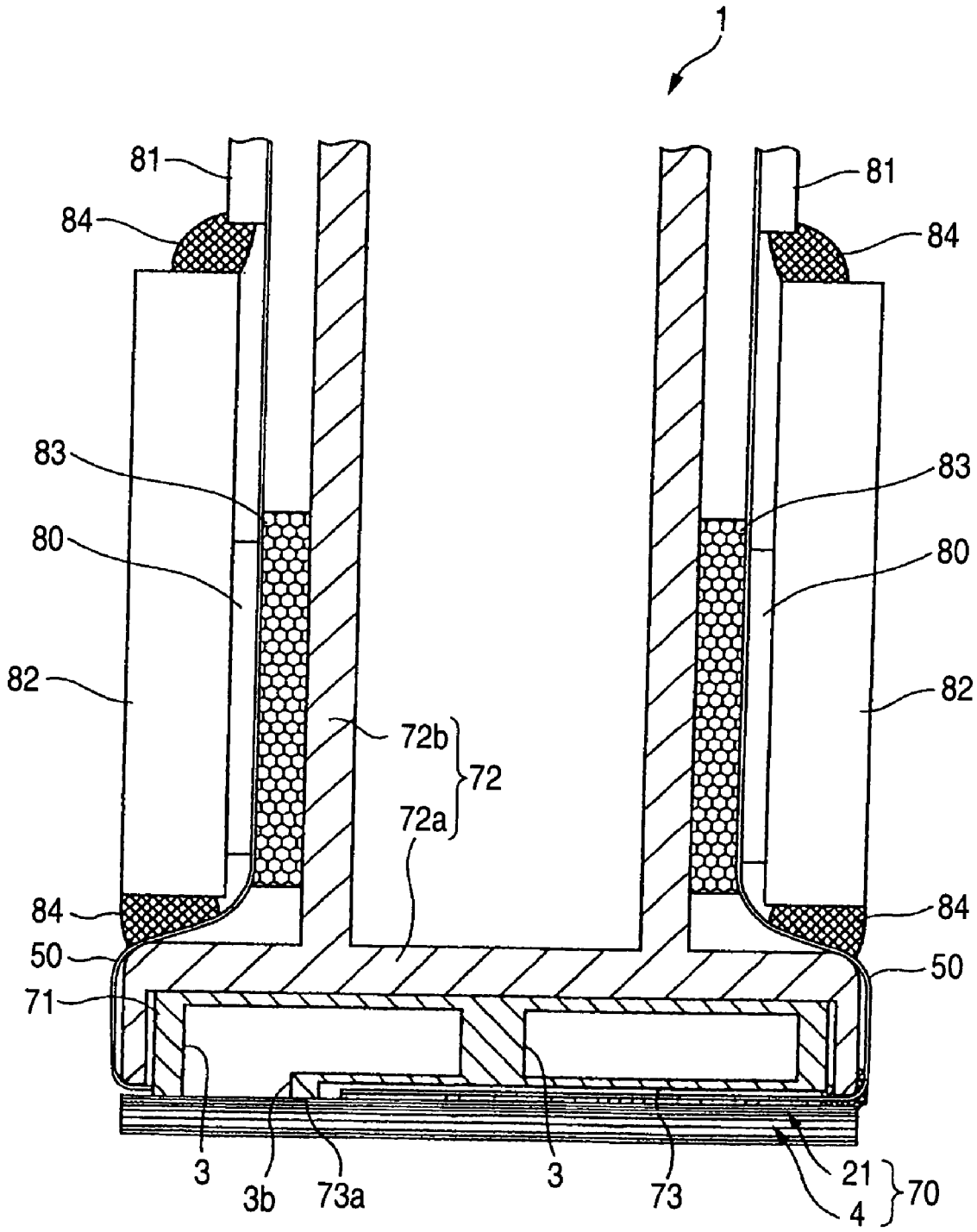
FIG. 2 is a sectional view taken along the line II—II in FIG. 1.

FIG. 1 is a perspective view showing the external appearance of an inkjet head according to an embodiment of the invention. FIG. 2 is a sectional view taken along the line II—II in FIG. 1. The inkjet head 1 has a head body 70, and a base block 71. The head body 70 extends in a main scanning direction so as to be shaped like a rectangle in plan view for ejecting ink onto a sheet of paper. The base block 71 is disposed above the head body 70 and includes ink reservoirs 3 which are flow paths of ink supplied to the head body 70.

The head body 70 includes a flow path unit 4, and a plurality of actuator units 21. Ink flow paths are formed in the flow path unit 4. The plurality of actuator units 21 are bonded onto an upper surface of the flow path unit 4. The flow path unit 4 and actuator units 21 are formed in such a manner that a plurality of sheet members are laminated and bonded to one another. Flexible printed circuit boards 50 (hereinafter referred to as FPCS) which are feeder circuit members are bonded onto an upper surface of the actuator units 21. The FPCs (signal lines) 50 are led upward while bent as shown in FIG. 2. The base block 71 is made of a metal material such as stainless steel. Each of the ink reservoirs 3 in the base block 71 is a nearly rectangular parallelepiped hollow region formed along a direction of the length of the base block 71.

A lower surface 73 of the base block 71 protrudes downward from its surroundings in neighbors of openings 3*b*. The base block 71 touches the flow path unit 4 only at neighbors 73*a* of the openings 3*b* of the lower surface 73. For this reason, all other regions than the neighbors 73*a* of the openings 3*b* of the lower surface 73 of the base block 71 are isolated from the head body 70 so that the actuator units 21 are disposed in the isolated portions.

The base block 71 is bonded and fixed into a cavity formed in a lower surface of a grip 72*a* of a holder 72. The holder 72 includes a grip 72*a*, and a pair of flat plate-like protrusions 72*b* extending from an upper surface of the grip 72*a* in a direction perpendicular to the upper surface of the grip 72*a* so as to form a predetermined distance between each other. The FPCs 50 bonded to the actuator units 21 are disposed so as to go along surfaces of the protrusions 72*b* of the holder 72 through elastic members 83 such as sponge respectively. Driver ICs 80 are disposed on the FPCs 50 disposed on the surfaces of the protrusions 72*b* of the holder 72. The FPCs 50 are electrically connected to the driver ICs 80 and the actuator units 21 (will be described later in detail) by soldering so that drive signals output from the driver ICs 80 are transmitted to the actuator units 21 of the head body 70.

Nearly rectangular parallelepiped heat sinks 82 are disposed closely on outer surfaces of the driver ICs 80, so that heat generated in the driver ICs 80 can be radiated efficiently. Boards 81 are disposed above the driver ICs 80 and the heat sinks 82 and outside the FPCs 50. Seal members 84 are disposed between an upper surface of each heat sink 82 and a corresponding board 81 and between a lower surface of each heat sink 82 and a corresponding FPC 50, respectively. That is, the heat sinks 82, the boards 81 and the FPCs 50 are bonded to one another by the seal members 84.

Figure 3:
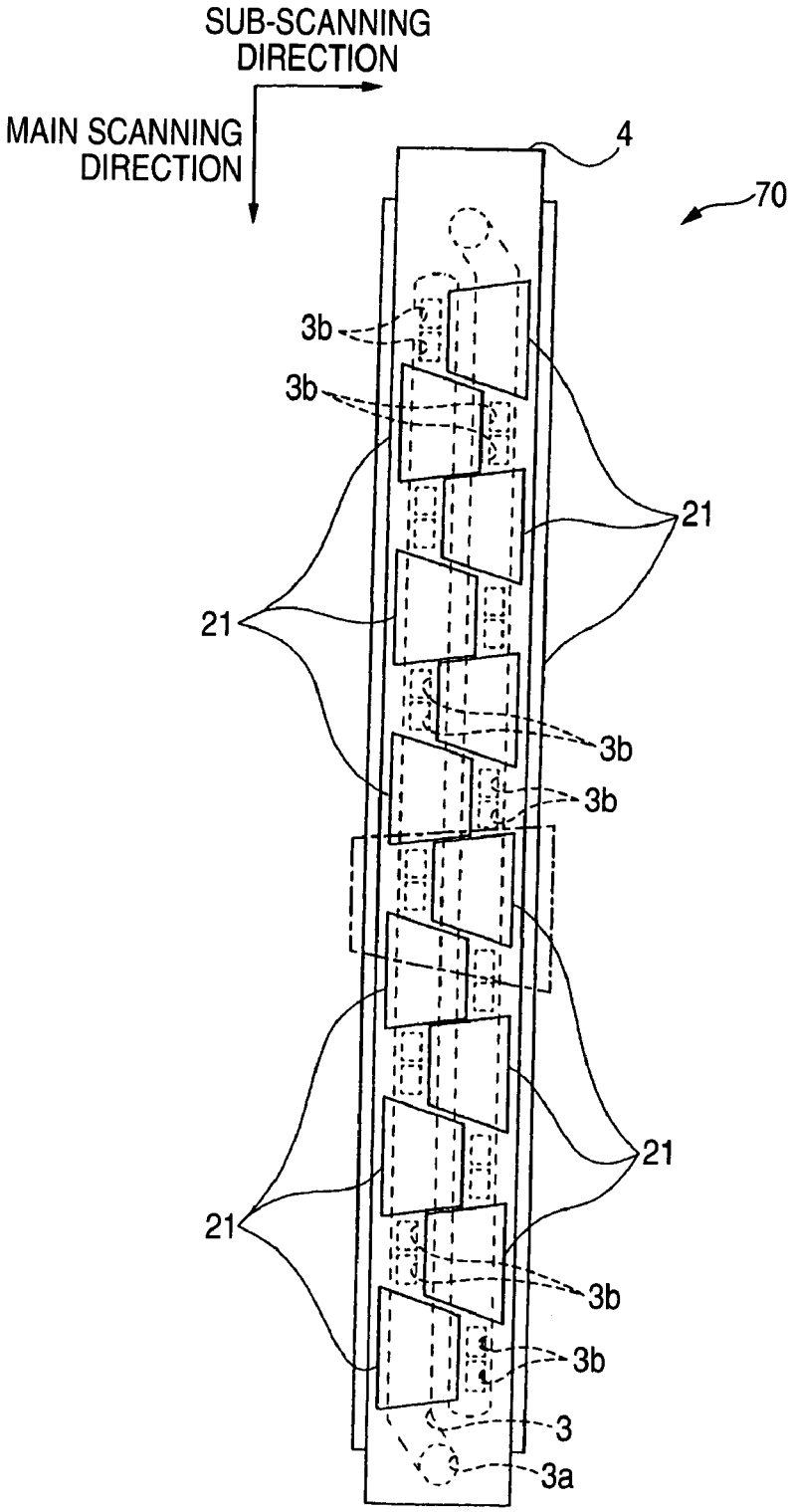
FIG. 3 is a plan view of a head body included in the ink-jet head depicted in FIG. 2.

FIG. 3 is a plan view of the head body included in the inkjet head depicted in FIG. 2. In FIG. 3, the ink reservoirs 3 formed in the base block 71 are drawn virtually by the broken line. Two ink reservoirs 3 extend in parallel to each other along a direction of the length of the head body 70 so as to form a predetermined distance between the two ink reservoirs 3. Each of the two ink reservoirs 3 has an opening 3*a* at its one end. The two ink reservoirs 3 communicate with an ink tank (not shown) through the openings 3*a* so as to be always filled with ink. A large number of openings 3*b* are provided in each ink reservoir 3 along the direction of the length of the head body 70. As described above, the ink reservoirs 3 are connected to the flow path unit 4 by the openings 3*b*. The large number of openings 3*b* are formed in such a manner that each pair of openings 3*b* are disposed closely along the direction of the length of the head body 70. The pairs of openings 3*b* connected to one ink reservoir 3 and the pairs of openings 3*b* connected to the other ink reservoir 3 are disposed in zigzag.

The plurality of actuator units 21 each shaped like a trapezoid in plan view are disposed in regions where the openings 3*b* are not provided. The plurality of actuator units 21 are disposed in zigzag so as to have a pattern reverse to that of the pairs of openings 3*b*. Parallel opposed sides (upper and lower sides) of each actuator unit 21 are parallel to the direction of the length of the head body 70. Inclined sides of adjacent actuator units 21 partially overlap each other in a direction of the width of the head body 70.

Figure 4:
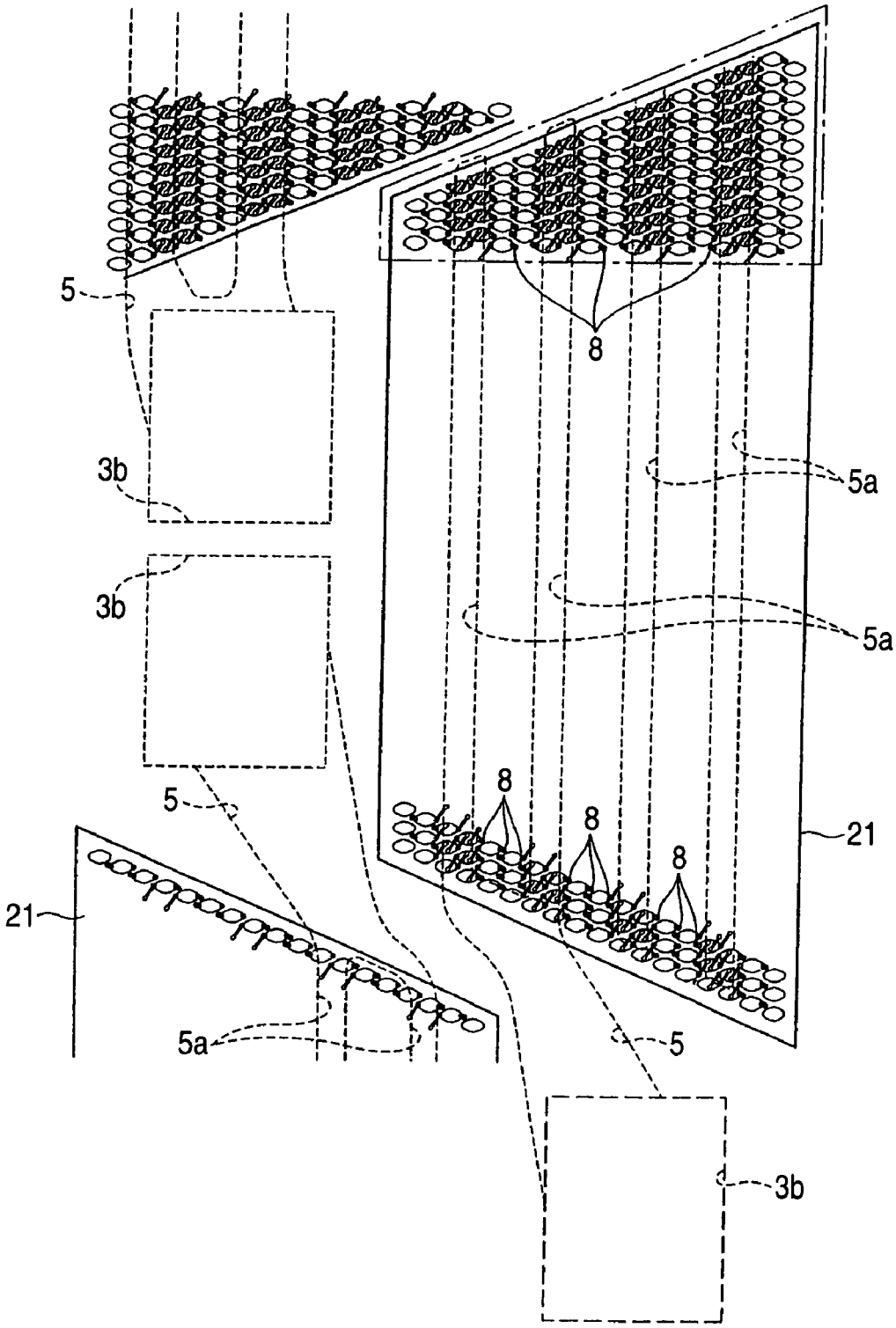
FIG. 4 is an enlarged view of a region surrounded by the chain line in FIG. 3.

FIG. 4 is an enlarged view of a region surrounded by the chain line in FIG. 3. As shown in FIG. 4, the openings 3*b* provided in each ink reservoir 3 communicate with manifolds 5 which are common ink chambers respectively. An end portion of each manifold 5 branches into two sub manifolds 5*a*. In plan view, every two sub manifolds 5*a* separated from adjacent openings 3*b* extend from two inclined sides of each actuator unit 21. That is, four sub manifolds 5 in total are provided below each actuator unit 21 and extend along the parallel opposed sides of the actuator unit 21 so as to be separated from one another.

Ink ejection regions are formed in a lower surface of the flow path unit 4 corresponding to the bonding regions of the actuator units 21. As will be described later, a large number of nozzles 8 are disposed in the form of a matrix in a surface of each ink ejection region. Although FIG. 4 shows several nozzles 8 for the sake of simplification, nozzles 8 are actually disposed on the whole of the ink ejection region.

Figure 5:
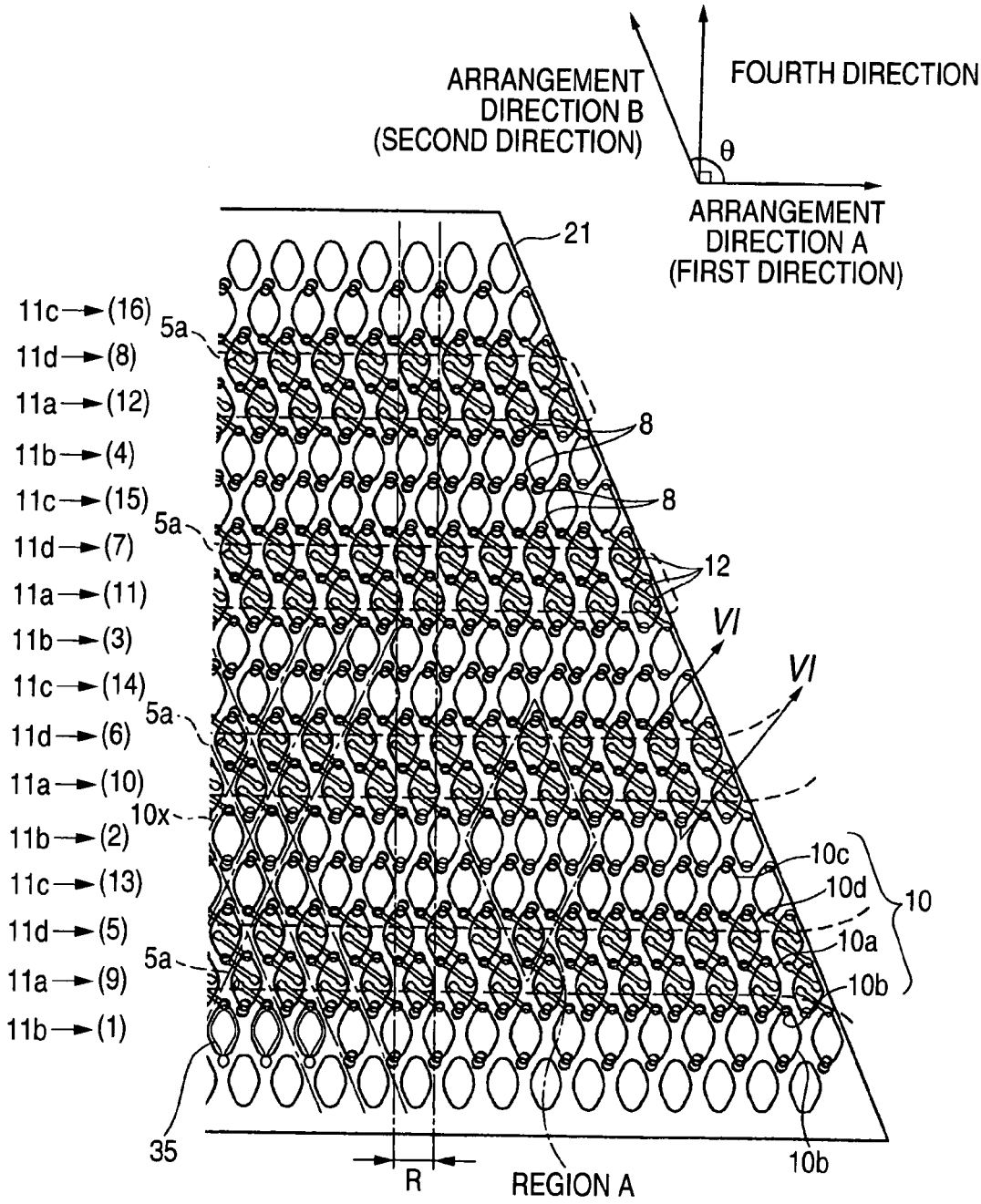
FIG. 5 is an enlarged view of a region surrounded by the chain line in FIG. 4.

FIG. 5 is an enlarged view of a region surrounded by the chain line in FIG. 4. FIGS. 4 and 5 show a state in which a plane of a large number of pressure chambers 10 disposed in the form of a matrix in the flow path unit 4 is viewed from a direction perpendicular to the ink ejection surface. Each of the pressure chambers 10 is shaped like a rhomboid having rounded corners in plan view. The long diagonal line of the rhomboid is parallel to the direction of the width of the flow path unit 4. The rhomboid has two acute-angled portions. Each pressure chamber 10 has two ends corresponding to the two acute-angled portions. One end of the pressure chamber 10 is connected to a corresponding nozzle 8. The other end of the pressure chamber 10 is connected to a corresponding sub manifold 5*a* as a common ink path through an aperture 12. An individual electrode 35 having a planar shape similar to but smaller by a size than that of each pressure chamber 10 is formed on the actuator unit 21 so as to be located in a position where the individual electrode 35 overlaps the pressure chamber 10 in plan view. Some of a large number of individual electrodes 35 are shown in FIG. 5 for the sake of simplification. Incidentally, the pressure chambers 10, apertures 12, etc. that must be expressed by the broken line in the actuator units 21 or in the flow path unit 4 are expressed by the solid line in FIGS. 4 and 5 to make it easy to understand the drawings.

In FIG. 5, a plurality of virtual rhombic regions 10*x* in which the pressure chambers 10 are stored respectively are disposed adjacently in the form of a matrix both in an arrangement direction A (first direction) and in an arrangement direction B (second direction) so that adjacent virtual rhombic regions 10*x* have common sides not overlapping each other. The arrangement direction A is a direction of the length of the inkjet head 1, that is, a direction of extension of each sub manifold 5*a*. The arrangement direction A is parallel to the short diagonal line of each rhombic region 10*x*. The arrangement direction B is a direction of one inclined side of each rhombic region in which an obtuse angle is formed between the arrangement direction B and the arrangement direction A. The central position of each pressure chamber 10 is common to that of a corresponding rhombic region 10*x* but the contour line of each pressure chamber 10 is separated from that of a corresponding rhombic region 10*x* in plan view.

The pressure chambers 10 disposed adjacently in the form of a matrix in the two arrangement directions A and B are formed at intervals of a distance corresponding to 37.5 dpi along the arrangement direction A. The pressure chambers 10 are formed so that sixteen pressure chambers are arranged in the arrangement direction B in one ink ejection region. Pressure chambers located at opposite ends in the arrangement direction B are dummy chambers that do not contribute to ink ejection.

The plurality of pressure chambers 10 disposed in the form of a matrix form a plurality of pressure chamber columns along the arrangement direction A shown in FIG. 5. The pressure chamber columns are separated into first pressure chamber columns 11*a*, second pressure chamber columns 11*b*, third pressure chamber columns 11*c* and fourth pressure chamber columns 11*d* in accordance with positions relative to the sub manifolds 5*a* viewed from a direction (third direction) perpendicular to the paper surface of FIG. 5. The first to fourth pressure chamber columns 11*a* to 11*d* are arranged cyclically in order of 11*c*.11*d*.11*a*.11*b*.11*c*.11*d*. . . . .11*b* from an upper side to a lower side of each actuator unit 21.

In pressure chambers 10*a* forming a first pressure chamber column 11*a* and pressure chambers 10*b* forming a second pressure chamber column 11*b*, nozzles 8 are unevenly distributed on a lower side of the paper surface of FIG. 5 in a direction (fourth direction) perpendicular to the arrangement direction A when viewed from the third direction. The nozzles 8 are located in lower end portions of corresponding rhombic regions 10*x* respectively. On the other hand, in pressure chambers 10*c* forming a third pressure chamber columns 11*c* and pressure chambers 10*d* forming a fourth pressure chamber columns 11*d*, nozzles 8 are unevenly distributed on an upper side of the paper surface of FIG. 5 in the fourth direction. The nozzles 8 are located in upper end portions of corresponding rhombic regions 10*x* respectively. In the first and fourth pressure chamber columns 11*a* and 11*d*, regions not smaller than half of the pressure chambers 10*a* and 10*d* overlap the sub manifolds 5*a* when viewed from the third direction. In the second and third pressure chamber columns 11*b* and 11*c*, the regions of the pressure chambers 10*b* and 10*c* do not overlap the sub manifolds 5*a* at all when viewed from the third direction. For this reason, pressure chambers 10 belonging to any pressure chamber column can be formed so that the sub manifolds 5*a* are widened as sufficiently as possible while nozzles 8 connected to the pressure chambers 10 do not overlap the sub manifold 5*a*. Accordingly, ink can be supplied to the respective pressure chambers 10 smoothly.

Figure 6:
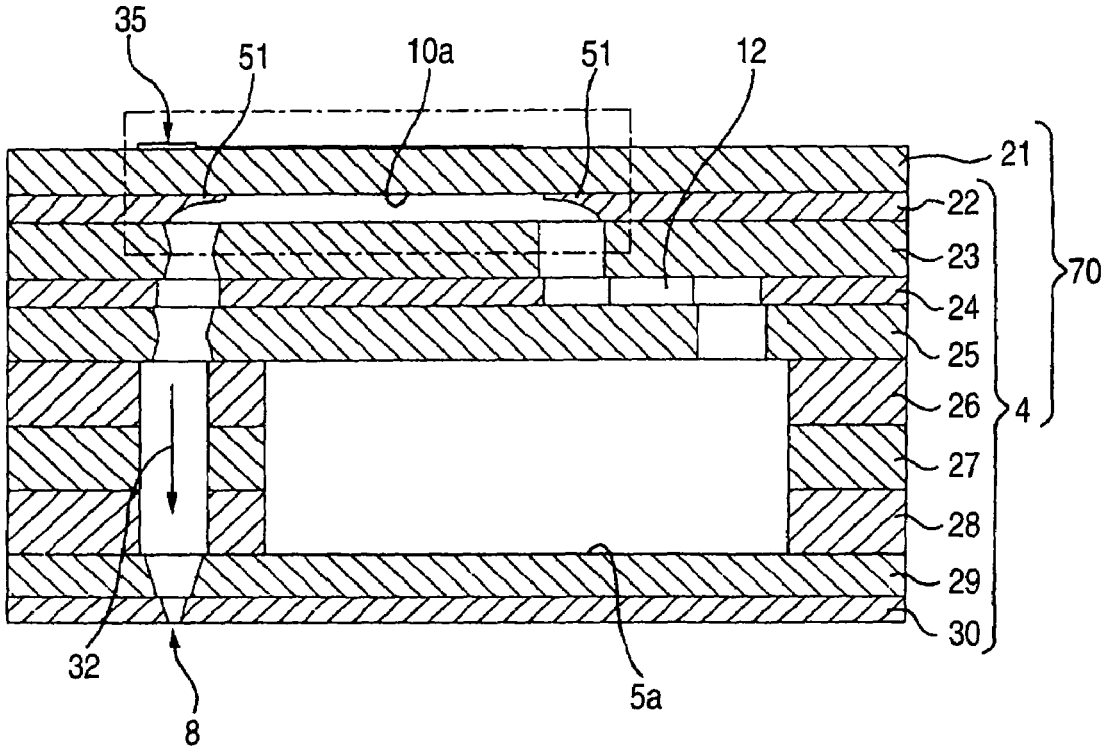
FIG. 6 is a sectional view taken along the line VI—VI in FIG. 5.

Next, the sectional structure of the head body 70 will be further described with reference to FIGS. 6 and 7. FIG. 6 is a sectional view taken along the line VI—VI in FIG. 5. One of pressure chambers 10*a* belonging to the first pressure chamber column 11*a* is shown in FIG. 6. As is obvious from FIG. 6, each nozzle 8 communicates with a sub manifold 5*a* through a pressure chamber 10 (10*a*) and an aperture 12. In this manner, individual ink flow paths 32 are formed in the head body 70 in accordance with the pressure chambers 10 so that each individual ink flow path 32 extends from an outlet of the sub manifold 5*a* to the nozzle 8 through the aperture 12 and the pressure chamber 10.

As is obvious from FIG. 6, the pressure chamber 10 and the aperture 12 are provided so as to be different in level from each other. Accordingly, as shown in FIG. 5, in the flow path unit 4 corresponding to the ink ejection region below the actuator unit 21, the aperture 12 connected to one pressure chamber 10 can be disposed in the same position as that of a pressure chamber 10 adjacent to the pressure chamber in plan view. As a result, the pressure chambers 10 can be disposed so densely as to adhere closely to one another, so that printing of a high-resolution image can be achieved by the inkjet head 1 though the inkjet head 1 has a relatively small occupied area.

Figure 7:
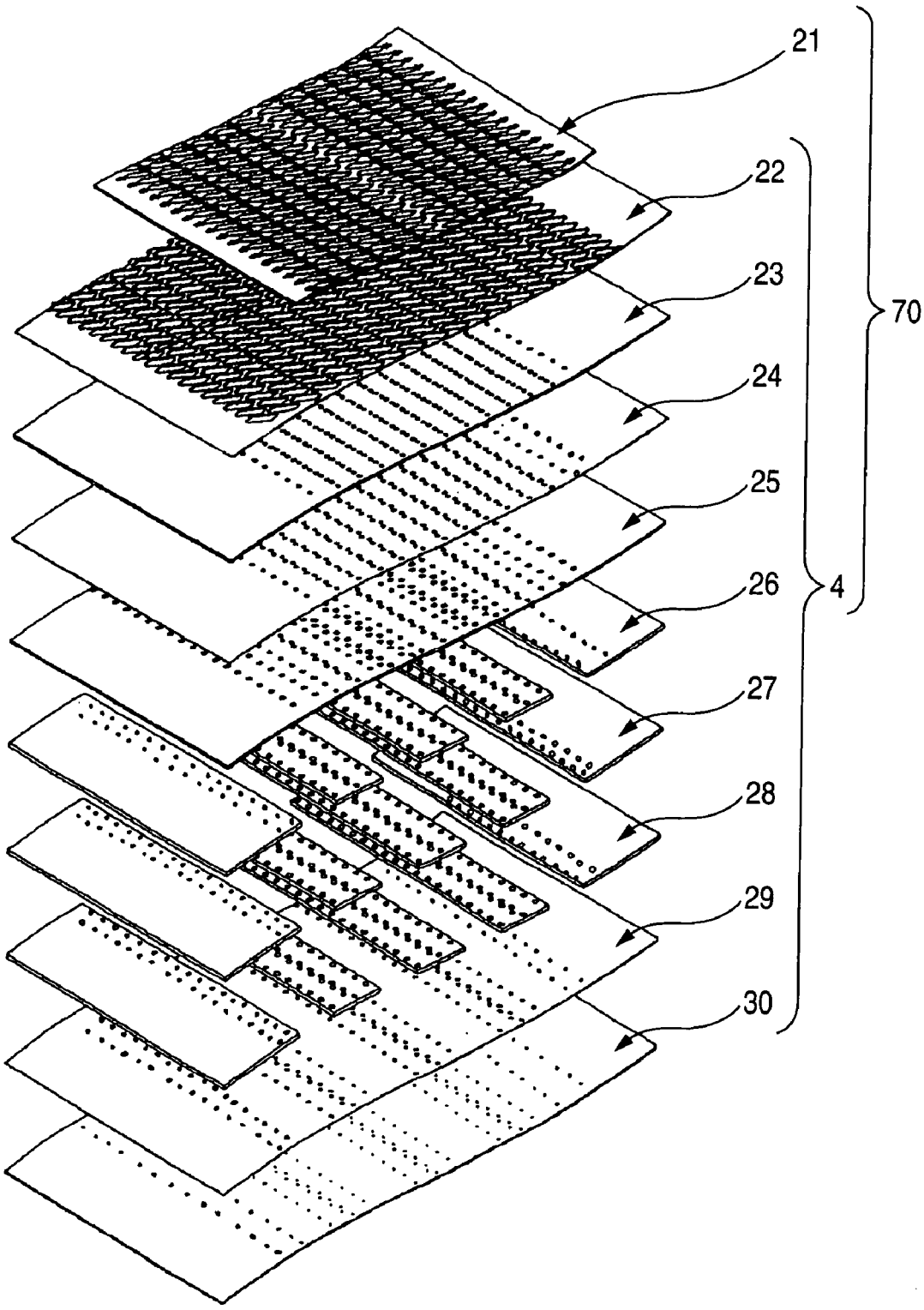
FIG. 7 is a partially exploded perspective view of the head body depicted in FIG. 6.

In FIG. 7, the head body 70 has a laminated structure in which ten sheet members in total, namely, an actuator unit 21, a cavity plate 22, a base plate 23, an aperture plate 24, a supply plate 25, manifold plates 26, 27 and 28, a cover plate 29 and a nozzle plate 30 are laminated in a descending order through an adhesive agent. The ten sheet members except the actuator unit 21, that is, nine sheet plates form the flow path unit 4.

As will be described later, the actuator unit 21 includes a laminate of four piezoelectric sheets 41 to 44 (see FIG. 8) as four layers, and electrodes disposed so that only the uppermost layer is provided as a layer having a portion serving as an active layer capable of being deformed based on the piezoelectric effect at the time of application of electric field (hereinafter referred to as "active layer-including layer") while the residual three layers are provided as non-active layers incapable of being deformed spontaneously. The cavity plate 22 is a metal plate having a large number of nearly parallelogrammatic openings corresponding to the pressure chambers 10. The base plate 23 is a metal plate which has holes each for connecting one pressure chamber 10 of the cavity plate 22 to a corresponding aperture 12, and holes each for connecting the pressure chamber 10 to a corresponding nozzle 8. The aperture plate 24 is a metal plate which has apertures 12, and holes each for connecting one pressure chamber 10 of the cavity plate 22 to a corresponding nozzle 8. The supply plate 25 is a metal plate which has holes each for connecting an aperture 12 for one pressure chamber 10 of the cavity plate 22 to a corresponding sub manifold 5*a*, and holes each for connecting the pressure chamber 10 to the nozzle 8. The manifold plates 26, 27 and 28 are metal plates which have the manifolds 5*a*, and holes each for connecting one pressure chamber 10 of the cavity plate 22 to a corresponding nozzle 8. The cover plate 29 is a metal plate which has holes each for connecting one pressure chamber 10 of the cavity plate 22 to a corresponding nozzle 8. The nozzle plate 30 is a metal plate which has nozzles 8 each provided for one pressure chamber 10 of the cavity plate 22.

The ten sheets 21 to 30 are laminated on each other while positioned so that individual ink flow paths 32 are formed as shown in FIG. 6. Each individual ink flow path 32 first goes upward from the sub manifold 5*a*, extends horizontally in the aperture 12, goes further upward from the aperture 12, extends horizontally again in the pressure chamber 10, goes obliquely downward in the direction of departing from the aperture 12 for a while and goes vertically downward to the nozzle 8. Incidentally, as shown in FIG. 5, all the holes for connecting the aperture 12 and the nozzle 8 to each other are connected to one another at the acute-angled portions of the pressure chamber 10.

Figure 8:
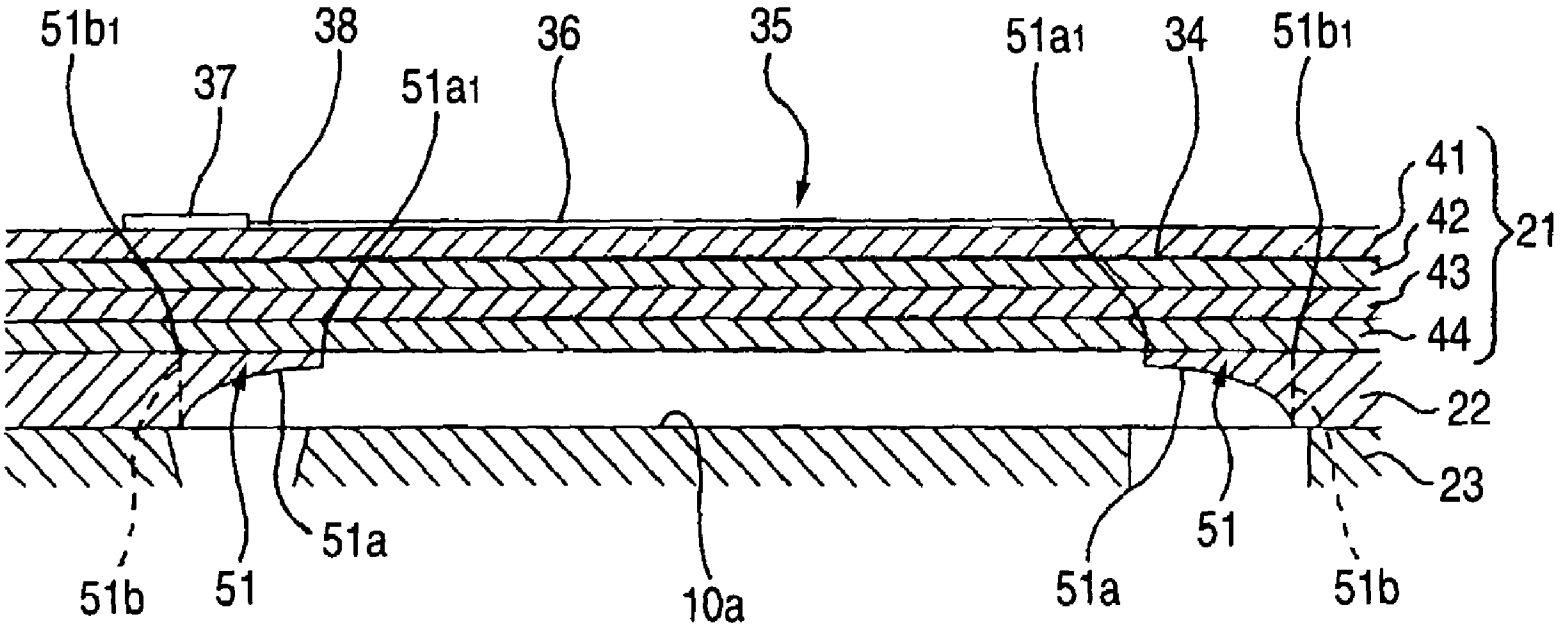
FIG. 8 is an enlarged view of a portion surrounded by the chain line in FIG. 6.
Figure 9:
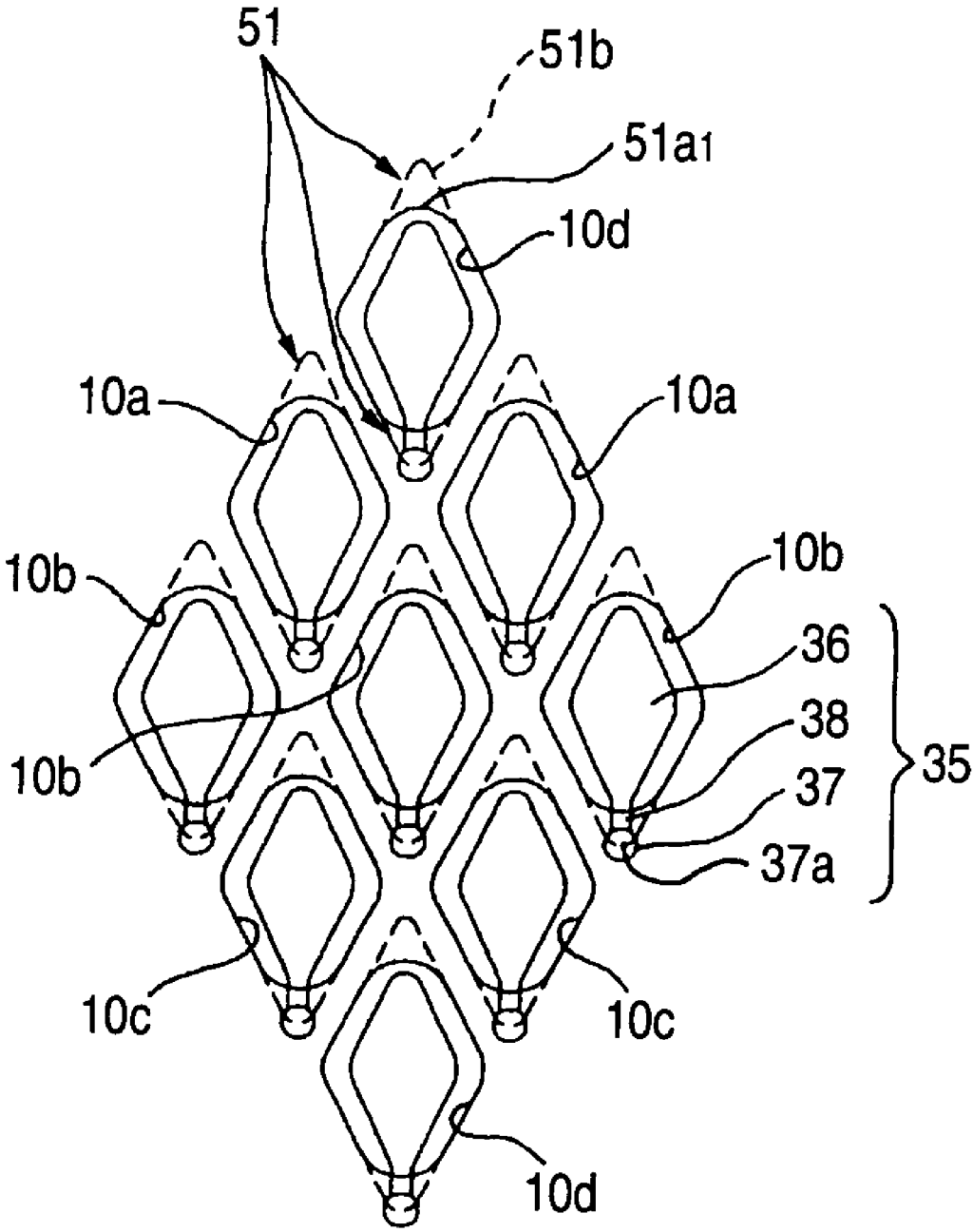
FIG. 9 is a view showing a state of arrangement of a plurality of individual electrodes overlapping pressure chambers respectively while showing a region A surrounded by the chain line in FIG. 5.

FIG. 8 is an enlarged view showing a region surrounded by the chain line in FIG. 6. FIG. 9 is an enlarged view showing a region A surrounded by the chain line in FIG. 5. FIGS. 8 and 9 show a state of arrangement of the individual electrodes overlapping the pressure chambers respectively. As shown in FIGS. 8 and 9, overhang portions 51 using the sectional shape of each pressure chamber 10 as an overhang shape are formed in portions of the cavity plate 22 corresponding to the neighbors of the two acute-angled portions of the pressure chamber 10 shaped like a rhomboid having rounded corners. In consideration of the sectional view shown in FIG. 8, the quantity of protrusion of each overhang portion 51 takes a maximum at a height level slightly lower than the height level (top height level) of the contact surface between the flow path unit 4 and the actuator unit 21, and the quantity of protrusion of each overhang portion 51 at a height level lower than the maximum decreases as the overhand portion 51 becomes farther from the actuator unit 21 and becomes nearer to the base plate 23 (i.e., as the height level decreases). In this embodiment, side walls 51*a* of each pressure chamber 10 protrude at neighbors of the boundary surface between the flow path unit 4 and the actuator unit 21 in a direction parallel to the boundary surface to thereby form the overhang portions 51. That is, each overhang portion 51 is a region of the cavity plate 22 surrounded by a side wall 51*a* of the pressure chamber 10 and a curved surface 51*b* as an extension of a line of intersection between the side wall 51*a* of the pressure chamber 10 and the base plate 23 in a direction of the thickness of the cavity plate 22.

Accordingly, as is also obvious from FIG. 9, each overhang portion 51 at the top height level is surrounded by an outer edge 51*a*1 as a line of intersection between the side wall 51*a* and the actuator unit 21 and an outer edge 51*b*1 as a line of intersection between the curved surface 51*b* and the actuator unit 21.

The side wall shape of the pressure chamber 10 having the overhang portions 51 is formed in such a manner that the cavity plate 22 is etched twice from the base plate 23 side surface while two masks, that is, a mask having a relatively small hole corresponding to the outer edge 51*a*1 and a mask having a relatively large hole corresponding to the outer edge 51*b*1 are used. When the pressure chamber 10 is formed by etching, each side wall 51*a* of the pressure chamber 10 can be shaped easily like the aforementioned curved surface so that the pressure chamber 10 is widened on the connection hole side. When each side wall 51*a* of the pressure chamber 10 is shaped as described above, air bubbles can be restrained from remaining in the pressure chamber 10. As a result, air bubbles in the pressure chamber 10 can be discharged from the nozzle easily. That is, a smooth flow path is formed when the overhang portions 51 are formed at the acute-angled portions of each pressure chamber 10 having holes connected to the aperture 12 and the nozzle 8 while the lower surface of each of the overhang portions 51 is shaped like a curved surface widened to the connection hole side. For this reason, air bubbles in ink are hardly reserved in the pressure chamber 10, so that the air bubbles in ink move to the outside of the pressure chamber 10 along the side walls of the pressure chamber 10 smoothly and are discharged from the nozzle.

The actuator unit 21 shown in FIG. 8 includes four piezoelectric sheets 41 to 44 formed to have a thickness of about 15 .m equally. The piezoelectric sheets 41 to 44 are provided as stratified flat plates (continuous flat plate layers) which are continued to one another so as to be arranged over a large number of pressure chambers 10 formed in one ink ejection region in the head body 70. Because the piezoelectric sheets 41 to 44 are arranged as continuous flat plate layers over the large number of pressure chambers 10, the individual electrodes 35 can be disposed densely on the piezoelectric sheet 41 when, for example, a screen printing technique is used. Accordingly, the pressure chambers 10 formed in positions corresponding to the individual electrodes 35 can be also disposed densely, so that a high-resolution image can be printed. Each of the piezoelectric sheets 41 to 44 is made of a ceramic material of the lead zirconate titanate (PZT) type having ferroelectricity.

The individual electrodes 35 are formed on the piezoelectric sheet 41 as the uppermost layer. A common electrode 34 having a thickness of about 2 .m is interposed between the piezoelectric sheet 41 as the uppermost layer and the piezoelectric sheet 42 located under the piezoelectric sheet 41 so that the common electrode 34 is formed on the whole surface of the piezoelectric sheet 42. Incidentally, no electrode is disposed between the piezoelectric sheet 42 and the piezoelectric sheet 43 and between the piezoelectric sheet 43 and the piezoelectric sheet 44. The individual electrodes 35 and the common electrode 34 are made of a metal material such as Ag—Pd.

As shown in FIG. 9, a main electrode region 36 having a thickness of about 1 .m and having a parallelogrammatic planar shape nearly similar to the shape of the pressure camber 10 is provided in each individual electrode 35. The nearly parallelogrammatic main electrode region 36 of the individual electrode 35 has two acute-angled portions. An extension portion 38 extending in the direction of the length of the main electrode region 36 is formed at one of the acute-angled portions of the main electrode region 36. A circular land portion (sub electrode region) 37 having a diameter of about 160 .m is provided at an end of the extension portion 38 so as to be electrically connected to the main electrode region 36. For example, the land portion 37 is made of gold containing glass frit. The land portion 37 is bonded onto a surface of the extension portion 38 in the individual electrode 35. Incidentally, signal lines formed in the FPC 50 are pressure-bonded to the land portions 37 so that drive signals can be given from the outside.

As shown in FIG. 9, the individual electrodes 35 are arranged in the form of a matrix as a whole while the land portion 37 of one individual electrode 35 is located between main electrode regions 36 of other adjacent individual electrodes 35 in plan view. On the other hand, each individual electrode 35 is arranged so that the land portion 37 is laid over the outer edge 51*b*1, that is, a part of the land portion 37 overlaps a corresponding overhang portion 51 at the top height level while the other part of the land portion 37 inclusive of the center 37*a* does not overlap the opening portion of the pressure chamber 10 partitioned by the outer edge 51*a*1 as a line of intersection between the side wall 51*a* and the actuator unit 21. Because the land portions 37 are arranged in the aforementioned manner, crosstalk can be reduced while a small-size head having pressure chambers 10*a* arranged densely can be achieved. That is, because each land portion 37 is provided near to the main electrode region 36 so that a part of the land portion 37 overlaps a corresponding overhang portion 51 at the top height level, the distance between the land portion 37 and the main electrode region 36 of another adjacent individual electrode 35 becomes relatively large. For this reason, when pressure is applied to ink in a certain pressure chamber 10 to eject ink from the nozzle 8 connected to the certain pressure chamber 10, the influence of displacement of the piezoelectric sheets 41 to 44 opposite to the land portion 37 of the certain pressure chamber 10 on displacement of the piezoelectric sheets 41 to 44 opposite to pressure chambers 10 adjacent to the certain pressure chamber 10 can be reduced compared with the background art. Accordingly, the influence of crosstalk can be reduced even in the case where ink is ejected from nozzles connected to adjacent pressure chambers simultaneously. As a result, the amount and speed of ink ejected from each nozzle 8 can be set at required values, so that print quantity can be improved.

Moreover, because a part of the land portion 37 overlaps the overhang portion 51 at the top height level, the land portion 37 and the FPC 50 can be bonded to each other by sufficient pressure. That is, if each land portion 37 is simply arranged near to the main electrode region 36 in order to achieve high-density arrangement of the pressure chambers 10 and reduction of crosstalk, only the four piezoelectric sheets 41 to 44 are located between the land portion 37 and the pressure chamber 10. In this case, the pressure used for bonding the land portion 37 and the FPC 50 to each other must be reduced to prevent the fragile piezoelectric sheets 41 to 44 of a ceramic material from being broken by the pressure. For this reason, it is impossible to keep sure electrical connection and high bonding strength between the land portion 37 and the FPC 50. On the other hand, in this embodiment, the overhang portion 51 is located, in addition to the four piezoelectric sheets 41 to 44, between the land portion 37 and the pressure chamber 10. Accordingly, rigidity can be increased by the thickness of the overhang portion 51 to thereby prevent the piezoelectric sheets 41 to 44 from being broken. Accordingly, the land portion 37 and the FPC 50 can be bonded to each other by sufficient pressure, so that both reliability and durability in connection between the two can be improved greatly. Moreover, in this embodiment, each land portion 37 is arranged so that the center of the land portion 37 is not located in the inside of the pressure chamber 10 over the outer edge 51*a*1. Accordingly, the piezoelectric sheets 41 to 44 are hardly broken by the pressure used for bonding the land portion 37 and the FPC 50 to each other.

In addition, in this embodiment, because the land portion 37 is not located in the inside of the pressure chamber 10 over the outer edge 51*a*1, displacement of the piezoelectric sheets 41 to 44 opposite to the main electrode region 36 is little disturbed even in the case where the FPC 50 is connected to the land portion 37.

The common electrode 34 shown in FIG. 8 is grounded at a region not shown. Accordingly, the common electrode 34 is kept at ground potential equally in regions corresponding to all the pressure chambers 10. The individual electrodes 35 are connected to the driver IC 80 through the FPC 50 including independent lead wires in accordance with the individual electrodes 35 so that electric potential can be controlled in accordance with each pressure chamber 10 (see FIGS. 1 and 2).

Next, a drive method of the actuator unit 21 will be described. The direction of polarization of the piezoelectric sheet 41 in the actuator unit 21 is a direction of the thickness of the piezoelectric sheet 41. That is, the actuator unit 21 has a so-called unimorph type structure in which one piezoelectric sheet 41 on an upper side (i.e., far from the pressure chambers 10) is used as a layer including an active layer while three piezoelectric sheets 42 to 44 on a lower side (i.e., near to the pressure chambers 10) are used as non-active layers. Accordingly, when the electric potential of an individual electrode 35 is set at a predetermined positive or negative value, an electric field applied portion of the piezoelectric sheet 41 put between electrodes serves as an active layer (pressure generation portion) and shrinks in a direction perpendicular to the direction of polarization by the transverse piezoelectric effect, for example, if the direction of the electric field is the same as the direction of polarization. On the other hand, the piezoelectric sheets 42 to 44 are not affected by the electric field, so that the piezoelectric sheets 42 to 44 are not displaced spontaneously. Accordingly, a difference in distortion in a direction perpendicular to the direction of polarization is generated between the piezoelectric sheet 41 on the upper side and the piezoelectric sheets 42 to 44 on the lower side, so that the whole of the piezoelectric sheets 41 to 44 is to be deformed so as to be curved convexly on the non-active side (unimorph deformation). On this occasion, as shown in FIG. 8, the lower surface of the whole of the piezoelectric sheets 41 to 44 is fixed to the upper surface of the partition wall (cavity plate) 22 which partitions the pressure chambers. As a result, the piezoelectric sheets 41 to 44 are deformed so as to be curved convexly on the pressure chamber side. For this reason, the volume of the pressure chamber 10 is reduced to increase the pressure of ink to thereby eject ink from a nozzle 8 connected to the pressure chamber 10. Then, when the electric potential of the individual electrode 35 is returned to the same value as the electric potential of the common electrode 34, the piezoelectric sheets 41 to 44 are restored to the original shape so that the volume of the pressure chamber 10 is returned to the original value. As a result, ink is sucked from the manifold 5 side.

Incidentally, another drive method may be used as follows. The electric potential of each individual electrode 35 is set at a value different from the electric potential of the common electrode 34 in advance. Whenever there is an ejection request, the electric potential of the individual electrode 35 is once changed to the same value as the electric potential of the common electrode 34. Then, the electric potential of the individual electrode 35 is returned to the original value different from the electric potential of the common electrode 34 at predetermined timing. In this case, the piezoelectric sheets 41 to 44 are restored to the original shape at the timing when the electric potential of the individual electrode 35 becomes equal to the electric potential of the common electrode 34. Accordingly, the volume of the pressure chamber 10 is increased compared with the initial state (in which the two electrodes are different in electric potential from each other), so that ink is sucked from the manifold 5 side into the pressure chamber 10. Then, the piezoelectric sheets 41 to 44 are deformed so as to be curved convexly on the pressure chamber 10 side at the timing when the electric potential of the individual electrode is set at the original value different from the electric potential of the common electrode 34 again. As a result, the volume of the pressure chamber 10 is reduced to increase the pressure of ink to thereby eject ink.

Referring back to FIG. 5, a zonal region R having a width (678.0 .m) corresponding to 37.5 dpi in the arrangement direction A and extending in the arrangement direction B will be considered. Only one nozzle 8 is present in any one of sixteen pressure chamber columns 11*a* to 11*d* in the zonal region R. That is, when such a zonal region R is formed in an optional position of the ink ejection region corresponding to one actuator unit 21, sixteen nozzles 8 are always distributed in the zonal region R. The positions of points obtained by projecting the sixteen nozzles 8 onto a line extending in the arrangement direction A are arranged at intervals of a distance corresponding to 600 dpi which is resolution at the time of printing.

When the sixteen nozzles 8 belonging to one zonal region R are numbered as (1) to (16) in rightward order of the positions of points obtained by projecting the sixteen nozzles 8 onto a line extending in the arrangement direction A, the sixteen nozzles 8 are arranged in ascending order of (1), (9), (5), (13), (2), (10), (6), (14), (3), (11), (7), (15), (4), (12), (8) and (16). When the inkjet head 1 configured as described above is driven suitably in accordance with the conveyance of a printing medium in the actuator unit 21, characters, graphics, etc. having resolution of 600 dpi can be drawn.

For example, description will be made on the case where a line extending in the arrangement direction A is printed with resolution of 600 dpi. First, brief description will be made on the case of a reference example in which each nozzle 8 is connected to the acute-angled portion on the same side of the pressure chamber 10. In this case, a nozzle 8 in the pressure chamber column located in the lowermost position in FIG. 5 begins to eject ink in accordance with the conveyance of the printing medium. Nozzles 8 belonging to adjacent pressure chamber columns on the upper side are selected successively to eject ink. Accordingly, dots of ink are formed so as to be adjacent to one another at intervals of a distance corresponding to 600 dpi in the arrangement direction A. Finally, a line extending in the arrangement direction A is drawn with resolution of 600 dpi as a whole.

On the other hand, in this embodiment, a nozzle 8 in the pressure chamber column 11*b* located in the lowermost position in FIG. 5 begins to eject ink. As the printing medium is conveyed, nozzles 8 connected to adjacent pressure chambers on the upper side are selected successively to eject ink. On this occasion, the displacement of the nozzle 8 position in the arrangement direction A in accordance with increase in position by one pressure chamber column from the lower side to the upper side is not constant. Accordingly, dots of ink formed successively along the arrangement direction A in accordance with the conveyance of the printing medium are not arranged at regular intervals of 600 dpi.

That is, as shown in FIG. 5, ink is first ejected from the nozzle (1) connected to the pressure chamber column 11*b* located in the lowermost position in FIG. 5 in accordance with the conveyance of the printing medium. A column of dots are formed on the printing medium at intervals of a distance corresponding to 37.5 dpi. Then, when the line forming position reaches the position of the nozzle (9) connected to the second lowest pressure chamber column 11*a* as the printing medium is conveyed, ink is ejected from the nozzle (9). As a result, a second ink dot is formed in a position displaced by eight times as large as the distance corresponding to 600 dpi in the arrangement direction A from the initial dot position.

Then, when the line forming position reaches the position of the nozzle (5) connected to the third lowest pressure chamber column 11*d* as the printing medium is conveyed, ink is ejected from the nozzle (5). As a result, a third ink dot is formed in a position displaced by four times as large as the distance corresponding to 600 dpi in the arrangement direction A from the initial dot position. When the line forming position reaches the position of the nozzle (13) connected to the fourth lowest pressure chamber column 11*c* as the printing medium is further conveyed, ink is ejected from the nozzle (13). As a result, a fourth ink dot is formed in a position displaced by twelve times as large as the distance corresponding to 600 dpi in the arrangement direction A from the initial dot position. When the line forming position reaches the position of the nozzle (2) connected to the fifth lowest pressure chamber column 11*b* as the printing medium is further conveyed, ink is ejected from the nozzle (2). As a result, a fifth ink dot is formed in a position displaced by the distance corresponding to 600 dpi in the arrangement direction A from the initial dot position.

Then, ink dots are formed in the same manner as described above while nozzles 8 connected to the pressure chambers 10 located on the upper side are selected successively in the ascending order as in FIG. 5. When N is the number of a nozzle 8 shown in FIG. 5 on this occasion, an ink dot is formed in a position displaced by a value corresponding to (the ratio n=N−1)×(the distance corresponding to 600 dpi) in the arrangement direction A from the initial dot position. Finally, when selection of the sixteen nozzles 8 is completed, fifteen dots formed at intervals of a distance corresponding to 600 dpi are interpolated in between ink dots formed at intervals of a distance corresponding to 37.5 dpi by the nozzle (1) in the lowest pressure chamber column 11*b* in FIG. 5. As a result, a line extending in the arrangement direction A can be drawn with resolution of 600 dpi as a whole.

Incidentally, neighbors of the opposite end portions (inclined sides of one actuator unit 21) in the arrangement direction A of an ink ejection region are complementary to neighbors of the opposite end portions in the arrangement direction A of an ink ejection region corresponding to another actuator unit 21 opposite in the direction of the width of the head body 70, so that printing with resolution of 600 dpi can be made.

Figure 10:
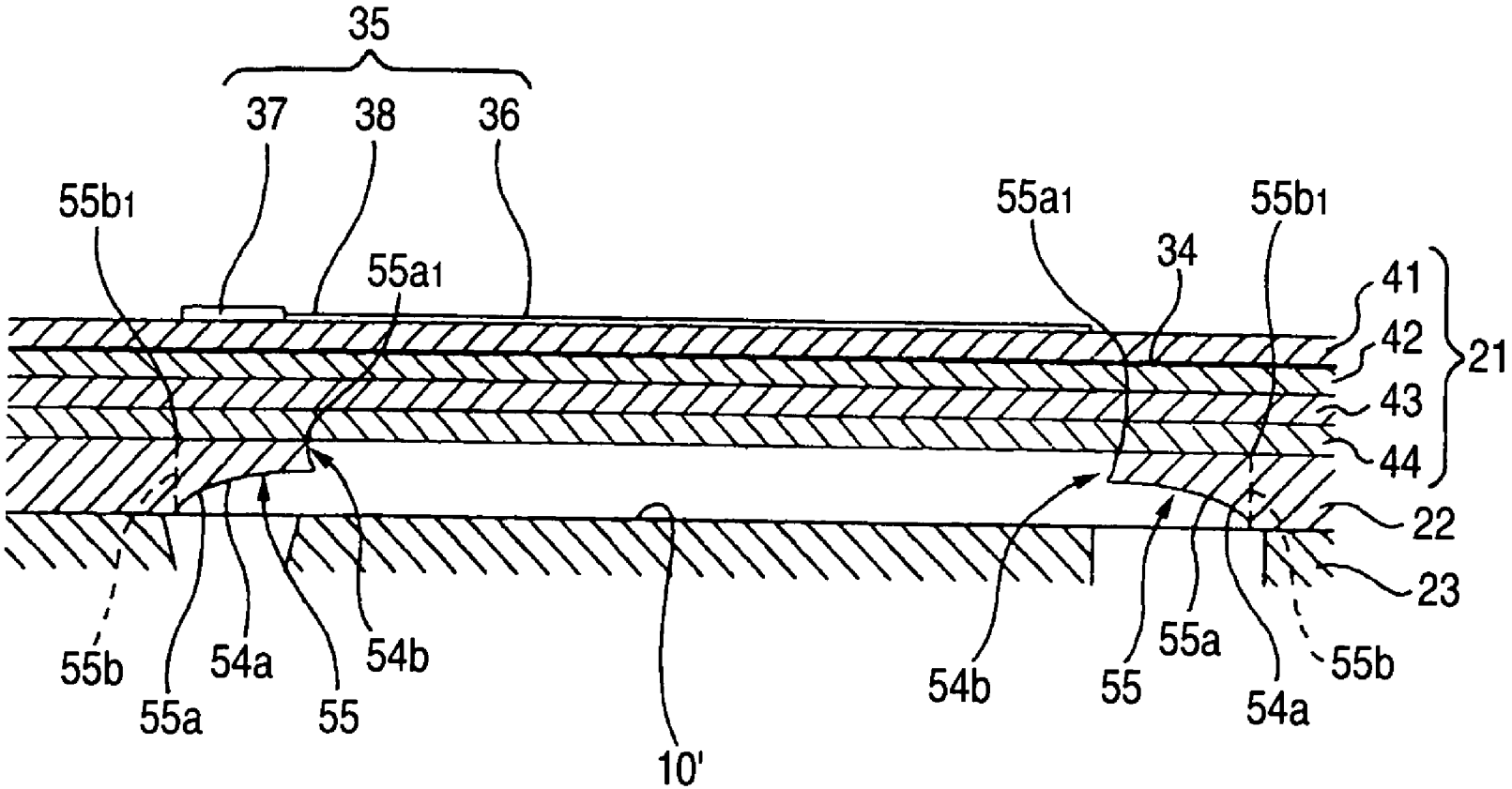
FIG. 10 is a sectional view showing a modified example of overhang portions of each pressure chamber formed in a cavity plate.
Figure 11:
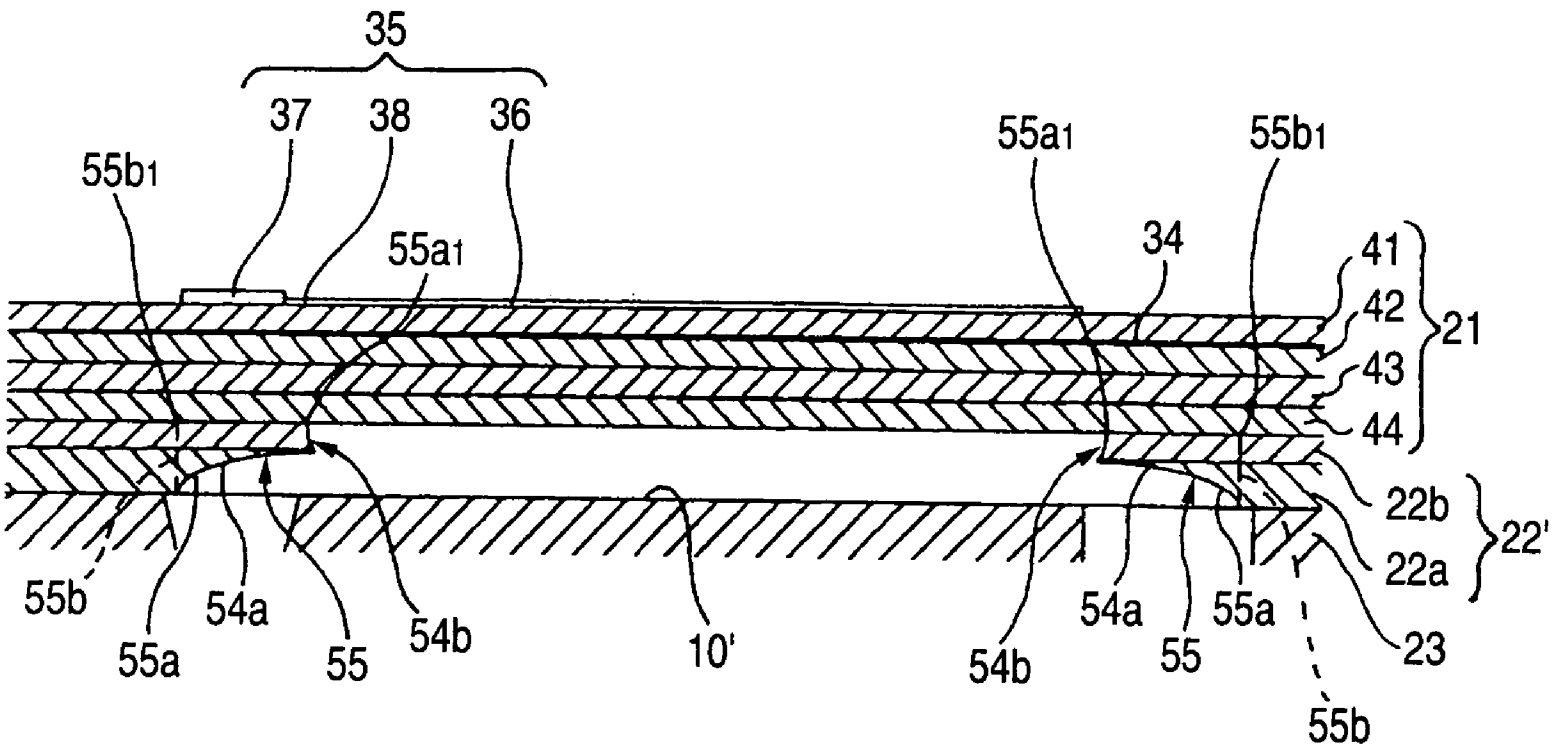
FIG. 11 is a sectional view showing another modified example of overhang portions of each pressure chamber in the case where the cavity plate is composed of two sheet members.
Figure 12:
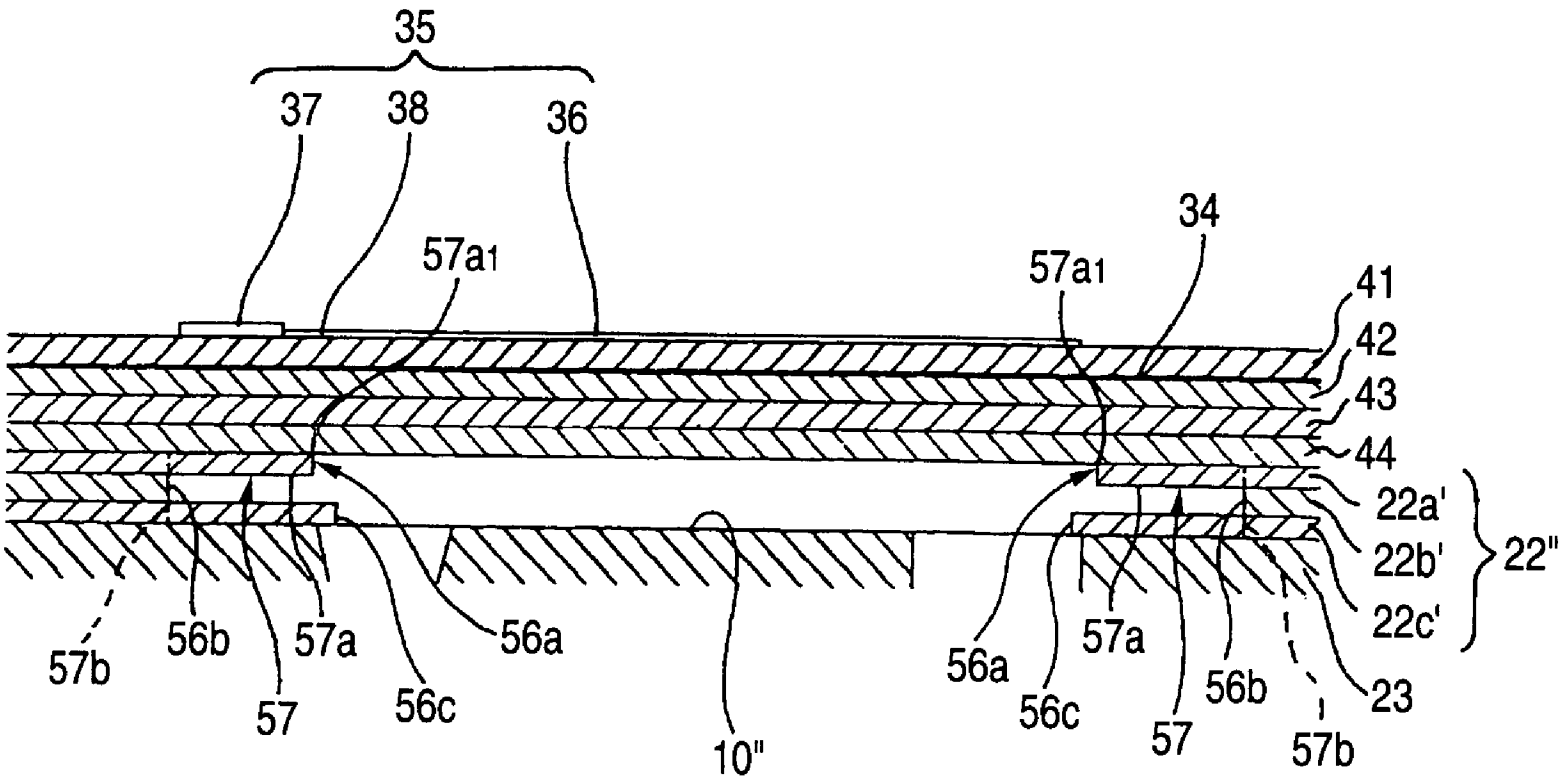
FIG. 12 is a sectional view showing a further modified example of overhang portions of each pressure chamber in the case where the cavity plate is composed of three sheet members.

In this embodiment, the shape of each overhang portion is not limited to the shape of the overhang portion 51 shown in FIGS. 8 and 9. For example, overhang portions 55 and 57 having shapes as shown in FIGS. 10 to 12 may be used. FIG. 10 is a sectional view showing a modified example of the overhang portion formed in the cavity plate. FIG. 11 is a sectional view showing another modified example of the overhang portion in the case where the cavity plate is composed of two sheet members. FIG. 12 is a sectional view showing a further modified example of the overhang portion in the case where the cavity plate is composed of three sheet members. Incidentally, like numerals refer to like parts for the sake of omission of duplicated description.

In the modified example shown in FIG. 10, over hang portions 55 are formed in the cavity plate 22 so as to be located in portions corresponding to the neighbors of the two acute-angled portions of each pressure chamber 10'. The planar shape of the pressure chamber 10' is the same as that of the aforementioned pressure chamber 10. When the sectional view shown in FIG. 10 is considered, the amount of protrusion of each overhang portion 55 takes a maximum at a height level slightly lower than the top height level. Each side wall 55*a* of the pressure chamber 10' protrudes in a direction parallel to the boundary surface between the flow path unit 4 and the actuator unit 21 so that the amount of protrusion decreases as the lower height level becomes farther from the actuator unit 21. In this manner, each overhang portion 55 is formed. That is, each overhang portion 55 is a region of the cavity plate 22 surrounded by a side wall 55*a* of the pressure chamber 10' and a curved surface 55*b* as an extension of a line of intersection between the side wall 55*a* of the pressure chamber 10' and the base plate 23 in a direction of the thickness of the cavity plate 22. Accordingly, each overhang portion 55 at the top height level is surrounded by an outer edge 55*a*1 as a line of intersection between the side wall 55*a* and the actuator unit 21 and an outer edge 55*b*1 as a line of intersection between the curved surface 55*b* and the actuator unit 21.

The overhang portions 55 are formed in such a manner that the cavity plate 22 is etched from its opposite surfaces when holes corresponding to the pressure chambers 10' are formed in the cavity plate 22. That is, each of holes formed in the cavity plate 22 is shaped so that the hole has a size covering both the connection hole connected to the sub manifold 5*a* and the connection hole connected to the nozzle 8, that is, a hole 54*a* formed by etching from the lower surface side of the cavity plate 22 is connected to a hole 54*b* formed by etching from the upper surface side of the cavity plate 22 so that the hole 54*b* is smaller than the hole 54*a* but similar to the hole 54*a*. The overhang portions 55 shaped in the aforementioned manner are formed in the cavity plate 22 on the basis of the size difference between the holes 54*a* and 54*b*.

When the pressure chambers 10' are formed by etching from the opposite surfaces of the cavity plate 22 in the aforementioned manner, the pressure chambers 10' can be formed in accurate positions of the cavity plate 22. That is, the two holes 54*a* and 54*b* for forming each pressure chamber 10' can be formed while positioned from the opposite surfaces of the cavity plate 22 respectively. Accordingly, an inkjet head having pressure chambers 10 formed with high positional accuracy can be produced.

In the modified example shown in FIG. 11, the shape of each overhang portion 55 is the same as that of the overhang portion 55 shown in FIG. 10. The pressure chamber 10' shown in FIG. 11 is the same as the pressure chamber 10' shown in FIG. 10 except that the cavity plate 22' shown in FIG. 11 is composed of two sheet members 22*a* and 22*b*. That is, as shown in FIG. 11, a hole 54*a* is formed in the sheet member 22*a* by etching while a hole 54*b* is formed in the sheet member 22*b* by etching. The sheet members 22*a* ad 22*b* having the holes 54*a* and 54*b* formed therein respectively are bonded to each other by an adhesive agent so that the holes 54*a* and 54*b* are integrated as one hole. In this manner, the cavity plate 22' is formed. When the cavity plate 22' having pressure chambers 10' formed therein is composed of the two sheet members 22*a* and 22*b* in the aforementioned manner, the side wall shape of each pressure chamber 10' corresponding to the overhang portion 55 can be decided with a higher degree of freedom than that in the previous case where the side walls of each pressure chamber 10 are formed by etching from a single surface side of the cavity plate. Accordingly, other side wall shapes than that of the pressure chamber 10' shown in FIG. 11 can be formed easily.

In the modified example shown in FIG. 12, pressure chambers 10" are formed in a cavity plate 22" composed of three sheet members 22*a*', 22*b*' and 22*c*'. Holes 56*a* to 56*c* formed in the sheet members 22*a*' to 22*c*' respectively overlap one another to thereby form each pressure chamber 10". Overhang portions 57 are formed in side walls of each pressure chamber 10". The holes 56*a* to 56*c* are formed so that the hole 56*a* formed in the sheet member 22*a*' is smaller than the hole 56*b* formed in the sheet member 22*b*' but similar to the hole 56*b* and is larger than the hole 56*c* formed in the sheet member 22*c*' but similar to the hole 56*c*. Incidentally, the shape of each of the holes 56*a* to 56*c* is made equal to the planar shape of the pressure chamber 10 shown in FIG. 9.

In FIG. 12, each overhang portion 57 is formed of only the sheet member 22*a*'. This is because the gap between the sheet member 22*a*' and 22*c*' prevents the sheet member 22*c*' from contributing to increase in pressure used for bonding the land portion 37 and the FPC 50 to each other though the sheet member 22*c*' protrudes in the same direction as the sheet member 22*a*'. That is, each overhang portion 57 is a region of the sheet member 22*a*' of the cavity plate 22" surrounded by a wall surface 57*a* facing the pressure chamber 10" and a curved surface 57*b* as an extension of a line of intersection between the wall surface 57*a* facing the pressure chamber 10" and the sheet member 22*b*' in a direction of the thickness of the cavity plate 22". Accordingly, each overhang portion 57 at the top height level is surrounded by an outer edge 57*a*1 as a line of intersection between the wall surface 57*a* and the actuator unit 21 and an outer edge 57*b*1 as a line of intersection between the curved surface 57*b* and the actuator unit 21.

As described above, also in the overhang portions 55 and 57 shaped as shown in FIGS. 10 to 12, the land portions 37 of the individual electrodes 35 are arranged so as to overlap the overhang portions 55 or 57. Accordingly, the crosstalk reducing effect can be obtained even in the case where the pressure chambers 10' or 10" are arranged densely. Moreover, when the pressure used for bonding the land portion 37 and the FPC 50 to each other is increased, both reliability and durability in connection between the two can be improved greatly. Although FIG. 12 shows the case where the connection holes connected to the aperture 12 and the nozzle 8 are formed so as to avoid the protrusion of the sheet member 22*c*', the connection holes may be formed so as to pass through the protrusion of the sheet member 22*c*'. In this case, the flow path including each pressure chamber 10 can be smoothened.

Figure 13A:
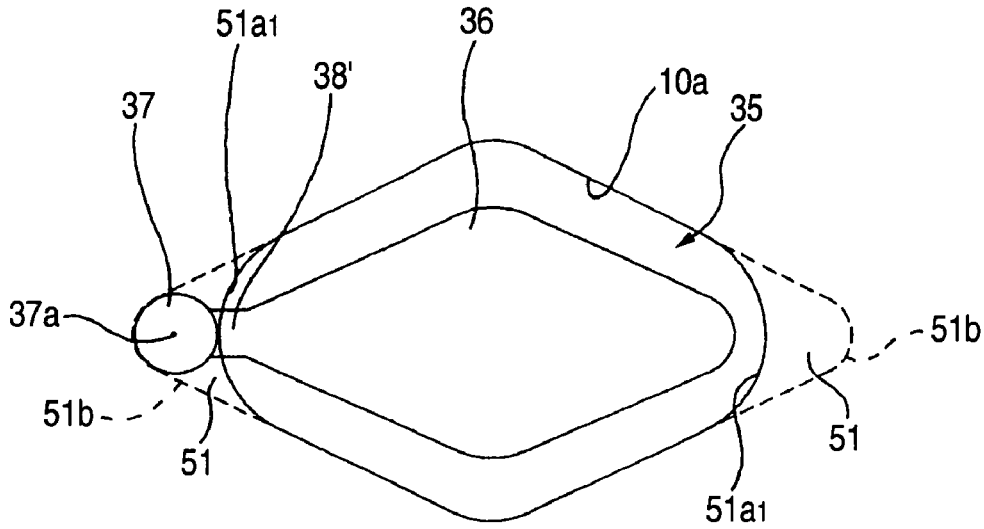
FIG. 13A is a plan view showing the positional relation between the individual electrode and the pressure chamber in a whole of the land portion of each individual electrode overlaps the overhang portion.
Figure 13B:
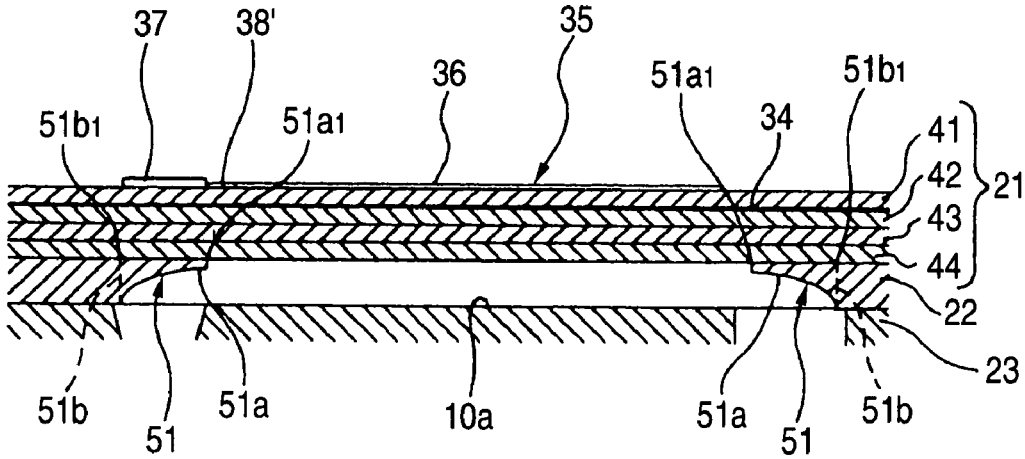
FIG. 13B is a sectional view showing the positional relation between the individual electrode and the pressure chamber in the whole of the land portion of each individual electrode overlaps the overhang portion.
Figure 14A:
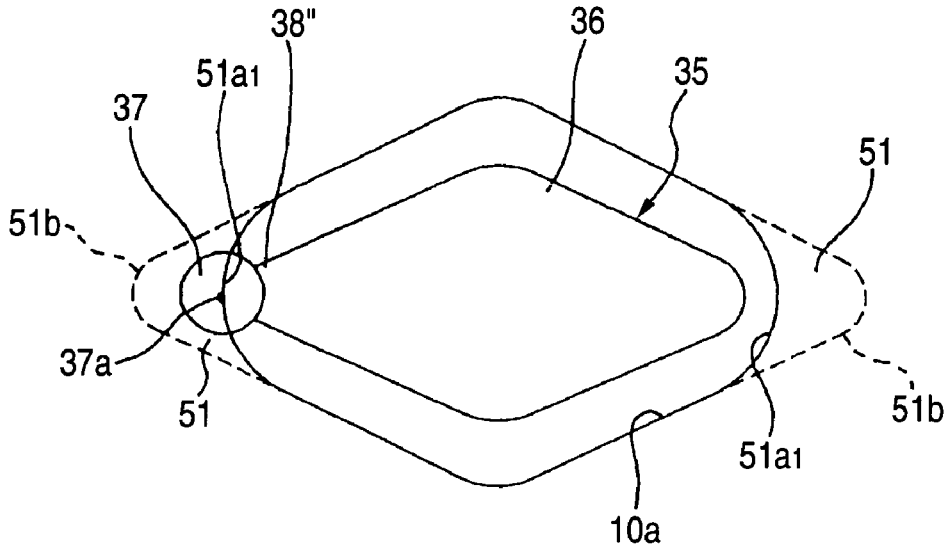
FIG. 14A is a plan view showing the positional relation between the individual electrode and the pressure chamber in a state that the land portion of each individual electrode is arranged so that the center of the land portion overlaps the outer edge of the overhang portion on a side facing the pressure chamber.
Figure 14B:
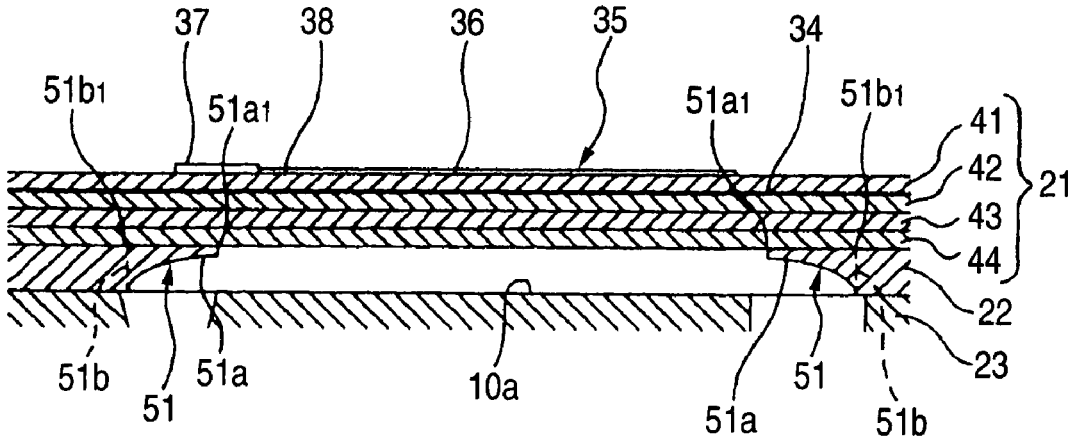
FIG. 14B is a sectional view showing the positional relation between the individual electrode and the pressure chamber in a state that the land portion of each individual electrode is arranged so that the center of the land portion overlaps the outer edge of the overhang portion on a side facing the pressure chamber.

The position of the land portion 37 of each individual electrode 35 is not limited to the aforementioned position. For example, the land portion 37 may be arranged in a position as shown in FIGS. 13A and 13B and FIGS. 14A and 14B. FIGS. 13A and 13B show a state in which the whole of the land portion of each individual electrode overlaps the overhang portion. FIG. 13A is a plan view showing the positional relation between the individual electrode and the pressure chamber. FIG. 13B is a sectional view showing the positional relation between the individual electrode and the pressure chamber. FIGS. 14A and 14B show a state in which the land portion of each individual electrode is arranged so that the center of the land portion overlaps the outer edge of the overhang portion facing the pressure chamber. FIG. 14A is a plan view showing the positional relation between the individual electrode and the pressure chamber. FIG. 14B is a sectional view showing the positional relation between the individual electrode and the pressure chamber. Incidentally, like numerals refer to like parts for the sake of omission of duplicated description.

In the modified example shown in FIGS. 13A and 13B, the whole of the land portion 37 of each individual electrode 35 overlaps the overhang portion 51 at the top height level. That is, an extension portion 38' extending from one of the acute-angled portions of the main electrode region 36 is formed so as to be shorter than the extension portion 38 shown in FIGS. 8 and 9. The land portion 37 is provided at an end of the extension portion 38'. When the land portion 37 of each individual electrode 35 is disposed in the overhang portion 51 at the top height level, that is, in a region of the overhang portion 51 surrounded by the outer edge 51*a*1 and the outer edge 51*b*1 as shown in FIGS. 13A and 13B in the aforementioned manner, the land portion 37 becomes farther from other individual electrodes 35 compared with the case shown in FIGS. 8 and 9. For this reason, crosstalk caused by the individual electrodes 35 is made so isotropic that crosstalk per se can be suppressed more greatly. Accordingly, print quality obtained finally can be improved more greatly.

In the modified example shown in FIGS. 14A and 14B, the land portion 37 of each individual electrode 35 is disposed so that the center 37*a* of the land portion 37 overlaps the outer edge 51*a*1 of the overhang portion 51 facing the pressure chamber 10 at the top height level. That is, an extension portion 38" extending from one of the acute-angled portions of the main electrode region 36 is formed so as to be shorter than the extension portion 38' shown in FIGS. 13A and 13B. The land portion 37 is provided at an end of the extension portion 38". When the land portion 37 of each individual electrode 35 is disposed so that the center 37*a* of the land portion 37 overlaps the outer edge 51*a*1 of the overhang portion 51 facing the pressure chamber at the top height level in the aforementioned manner, the land portion 37 becomes farther from other individual electrodes 35 compared with the case shown in FIGS. 13A and 13B. For this reason, crosstalk can be suppressed more effectively.

Although preferred embodiments of the invention have been described above, the invention is not limited to the aforementioned embodiments and various changes may be made on design without departing from the scope of claim. For example, in the aforementioned embodiments, each land portion 37 may be disposed in any position as long as the land portion 37 can be located between the position where the center 37*a* of the land portion 37 overlaps the outer edge 51*a*1 of the overhang portion 51 facing the pressure chamber 10 at the top height level and the position where the land portion 37 does not overlap the overhang portion 51 at the top height level but the outer edge of the land portion 37 overlaps the outer edge 51*b*1 of the overhang portion 51 not facing the pressure chamber 10 at the top height level. The shape of the overhang portion is not limited to the aforementioned one but can be also changed at option. For example, the overhang portion may be provided as a beam-shaped overhang portion which is formed so as to support the actuator unit from below and bridge between the opposite wall portions of each pressure chamber. In the invention, the overhang portion may be provided in the pressure chamber between the top height level and the height level where each side wall of the pressure chamber does not protrude as long as the amount of protrusion of each side wall of the pressure chamber at the top height level is larger than the amount of protrusion of each side wall of the pressure chamber at any height level different from the top height level.

Although the aforementioned embodiments have shown the case where the bottom surface of the actuator unit 21 forms the top surface of each pressure chamber 10, another sheet member may be disposed between the pressure chamber 10 and the actuator unit 21.

The position where each overhang portion is provided in the pressure chamber need not be near the acute-angled portion of the pressure chamber. The plurality of pressure chambers need not be arranged in the form of a matrix as described above in the aforementioned embodiments. Each overhang portion may be disposed in any position as long as the position at least corresponds to the position where the sub electrode region of a corresponding individual electrode is provided.

Although the inkjet head 1 in the aforementioned embodiments is of a line type, the invention may be also applied to a serial type inkjet head. Each side wall of the pressure chamber 10 need not be shaped like a curved surface having a region which decreases as the location becomes farther from the overhang portion 51. The directions of arrangement of the pressure chambers 10 in the form of a matrix along a surface of the flow path unit 4 are not limited to the arrangement directions A and B shown in FIG. 5 in the aforementioned embodiments. Various directions may be used as long as the directions can be provided along the surface of the flow path unit 4. The shape of the region in which each pressure chamber 10 is contained need not be rhombic. Any shape such as a parallelogrammatic shape may be used as the shape of the region. The planar shape of the pressure chamber 10 per se contained in the region may be changed to another shape suitably. The pressure chamber 10 and the sub manifold 5*a* may be connected to each other directly without interposition of the aperture 12. The flow path unit 4 need not be provided as a laminate of a plurality of sheet members.

The materials of the piezoelectric sheets and electrodes in the actuator unit 21 are not limited to the aforementioned materials. For example, other known materials may be used. An electrically insulating sheet as another sheet than the piezoelectric sheet may be used as each non-active layer. The number of active layer-including layers, the number of non-active layers, etc. may be changed suitably. The number of individual electrodes and the number of common electrodes may be changed suitably in accordance with the number of laminated piezoelectric sheets. Although the aforementioned embodiments have shown the case where the electric potential of the common electrode is kept at ground potential, the electric potential of the common electrode is not limited thereto as long as the electric potential is common to the pressure chambers 10.

Although the embodiments have shown the case where the actuator unit 21 is provided so that a non-active layer is disposed on the pressure chamber side of the active layer-including layer, the active layer-including layer may be disposed on the pressure chamber 10 side of a non-active layer or there may be no provision of any non-active layer. Incidentally, when the non-active layer is provided on the pressure chamber side of the active layer-including layer, there can be expectation that efficiency in displacement of the actuator unit 21 will be improved more greatly.

Although the embodiments have shown the case where a plurality of actuator units 21 each shaped like a trapezoid are arranged into two rows in zigzag as shown in FIG. 3, each actuator unit need not be trapezoidal. A plurality of actuator units may be arranged simply into one row along the direction of the length of the flow path unit. Or a plurality of actuator units may be arranged into three or more rows in zigzag. One actuator unit 21 need not be arranged so as to be laid over a plurality of pressure chambers 10. One actuator unit 21 may be arranged for each pressure chamber 10.

A large number of common electrodes 34 may be formed in accordance with every pressure chamber 10 so that the region of projection in the laminating direction contains the pressure chamber region or the region of protection is contained in the pressure chamber region. The common electrode 34 need not be provided as an electrically conductive sheet provided on the near whole region in the actuator unit 21. Incidentally, in this case, it is necessary to electrically connect the common electrodes to one another so that all portions corresponding to the pressure chambers 10 have the same electric potential.

At a point common to the embodiments described above, the actuator unit is formed so that a common electrode is provided so as to be laid over a plurality of pressure chambers, and that the common electrode is disposed opposite to sub electrode regions of individual electrodes corresponding to the pressure chambers. In the embodiments, the overhang portions provided in the pressure chambers are used as places where the sub electrode regions of the individual electrodes are set and which particularly serve as points bonded to the FPC. The main reasons are in that crosstalk can be suppressed effectively because each sub electrode region is disposed so as to be relatively far from adjacent pressure chambers, and in that the actuator unit can be prevented from being broken at the time of pressure-bonding the sub electrode region and the FPC to each other because the sub electrode region can be structurally supported by the overhang portion from below. In consideration of the fact that each reason is derived from the positional relation between the overhang portion formed in the pressure chamber and the sub electrode region of the individual electrode, the common electrode need not be formed so as to be laid over the plurality of pressure chambers. That is, common electrodes may be formed for the pressure chambers respectively in the same manner as the individual electrodes. The common electrode need not be located opposite to each sub electrode region as long as the common electrode can be disposed near to the sub electrode region. For example, also when the common electrode is not located opposite to the sub electrode region but disposed near to the sub electrode region, crosstalk corresponding to the position of setting of the sub electrode region occurs by application of a voltage though the crosstalk is relatively low compared with the case where the common electrode is disposed opposite to the sub electrode region. Therefore, each sub electrode region is disposed between the position where the center of the sub electrode region overlaps the outer edge of the overhang portion on a side facing the pressure chamber and the position where the sub electrode region overlaps the outer edge of the overhang portion on a side not facing the pressure chamber. In this manner, the effect common to the aforementioned embodiments can be obtained.

What is claimed is:

1. An inkjet head comprising:

a flow path unit including pressure chambers arranged along a plane, and which is connected to nozzles respectively; and an actuator unit fixed to a surface of the flow path unit, which changes volume of each of the pressure chambers, the actuator unit including:

individual electrodes each having a main electrode region disposed in a position opposite to corresponding pressure chambers; and a sub electrode region continued to the main electrode region and connected to a signal line;

a common electrode laid over the pressure chambers; and a piezoelectric sheet disposed between the common electrode and the individual electrodes, wherein the flow path unit includes at least one overhang portion provided in the pressure chambers and formed in such a manner that at least amount of protrusion of each side wall of each pressure chamber in a direction along the plane at a top height level as the height nearest to the actuator unit is larger than an amount of protrusion of each of side walls of each pressure chamber in the direction along the plane at any height level different from the top height level on an assumption that the height level is virtually provided in a direction from the pressure chamber to the actuator unit, and each sub electrode region is disposed between a position where a center of the sub electrode region at least partially overlaps an outer edge of a corresponding overhang portion on a side facing the pressure chamber at the top height level and a position where the sub electrode region does not overlap a corresponding overhang portion at the top height level but an outer edge of the sub electrode region overlaps an outer edge of a corresponding overhang portion on a side not facing the pressure chamber.

2. An inkjet head according to clam 1, wherein the center of each sub electrode region overlaps a corresponding overhang portion at the top height level.

3. An inkjet head according to clam 2, wherein a whole of each sub electrode region overlaps the corresponding overhang portion at the top height level.

4. An inkjet head according to claim 2, wherein the main electrode is included in a center region of each of the pressure chambers defined by the outer edge of the overhang portion on the side facing the pressure chamber and an outer edge of each of the pressure chambers.

5. An inkjet head according to claim 1, wherein each of the pressure chambers is shaped like at least one of parallelogram and a corner-rounded parallelogram having two acute-angled portions in plan view so that the each sub electrode region at least partially overlaps the overhang portion provided in one of the two acute-angled portions of the corresponding pressure chamber.

6. An inkjet head according to claim 1, wherein the individual electrodes and the pressure chambers are disposed in the form of a matrix so that the sub electrode region of each individual electrode is located between the main electrode regions of other two individual electrodes.

7. An inkjet head according to claim 1, wherein the each overhang portion has a region in which the amount of protrusion in the direction along the plane decreases as the height level becomes farther than the top height level.

8. An inkjet head according to claim 1, wherein the flow path unit includes a plurality of sheet members laminated on one another; and the overhang portions are formed in such a manner that one of the sheet members used for forming at least part of spaces of the pressure chambers is etched from a surface opposite to the nozzles.

9. An inkjet head according to claim 1, wherein the flow path unit includes a plurality of sheet members laminated on one another; and the overhang portions are formed in such a manner that one of the sheet members used for forming at least part of spaces of the pressure chambers is etched from opposite surface of the one of the sheet members.

10. An inkjet head according to claim 1, wherein the flow path unit includes a plurality of sheet members laminated on one another; and the overhang portions are formed in such a manner that the at least two sheet members having holes are laminated on each other so that the positions of outer edges facing the holes are different from each other.

11. An inkjet head comprising:

a flow path unit including pressure chambers arranged along a plane, and which is connected to nozzles respectively; and an actuator unit fixed to a surface of the flow path unit, which changes volume of each of the pressure chambers, the actuator unit including:

individual electrodes each having a main electrode region disposed in a position opposite to corresponding one of the pressure chambers; and a sub electrode region continued to the main electrode region and connected to a signal line;

a common electrode kept at common electric potential; and a piezoelectric sheet put between the common electrode and the individual electrodes so as to be laid over the pressure chambers, wherein the flow path unit includes at least one overhang portion provided in the pressure chambers and formed in such a manner that at least amount of protrusion of each of side walls of each pressure chamber in a direction along the plane at a top height level as the height nearest to the actuator unit is larger than an amount of protrusion of each of side walls of each pressure chamber in the direction along the plane at any height level different from the top height level on an assumption that the height level is virtually provided in a direction from the pressure chamber to the actuator unit, and each sub electrode region is disposed between a position where a center of the sub electrode region at least partially overlaps an outer edge of a corresponding overhang portion on a side facing the pressure chamber at the top height level and a position where the sub electrode region does not overlap a corresponding overhang portion at the top height level but an outer edge of the sub electrode region overlaps an outer edge of a corresponding overhang portion on a side not facing the pressure chamber.

* * * * *